US009254550B2

(12) United States Patent
Haverty et al.

(10) Patent No.: US 9,254,550 B2
(45) Date of Patent: Feb. 9, 2016

(54) SURFACE COATING PROCESSES AND USES OF SAME

(75) Inventors: Donncha Haverty, Nenagh (IE); Brendan Kennedy, Kilmacow (IE)

(73) Assignee: HKPB Scientific Limited, Nenagh, Co. Tipperary (IE)

( * ) Notice: Subject to any disclaimer, the term of this patent is extended or adjusted under 35 U.S.C. 154(b) by 1649 days.

(21) Appl. No.: 12/738,548

(22) PCT Filed: Oct. 16, 2008

(86) PCT No.: PCT/EP2008/064005

§ 371 (c)(1), (2), (4) Date: Sep. 8, 2010

(87) PCT Pub. No.: WO2009/050251

PCT Pub. Date: Apr. 23, 2009

(65) Prior Publication Data

US 2010/0211158 A1 Aug. 19, 2010

(30) Foreign Application Priority Data

Oct. 16, 2007 (IE) ..... 2007/0753
Oct. 16, 2007 (IE) ..... 2007/0754

(51) Int. Cl.

| | |
|---|---|
| ***B05D 1/12*** | (2006.01) |
| ***B24C 1/10*** | (2006.01) |
| ***B24C 11/00*** | (2006.01) |
| ***C23C 24/04*** | (2006.01) |

(52) U.S. Cl.
CPC ... *B24C 1/10* (2013.01); *B05D 1/12* (2013.01); *B24C 11/005* (2013.01); *C23C 24/04* (2013.01)

(58) Field of Classification Search
CPC ..... A61L 33/00; A61F 2/00; A61N 5/00; B05D 1/12
USPC ..... 427/34, 422, 423, 367, 2.1, 458, 180; 424/422, 423; 117/65; 600/3
See application file for complete search history.

(56) References Cited

U.S. PATENT DOCUMENTS

| | | | | |
|---|---|---|---|---|
| 3,754,976 | A | 8/1973 | Babecki et al. | |
| 4,224,356 | A * | 9/1980 | Singer | 427/455 |
| 4,753,094 | A * | 6/1988 | Spears | 72/53 |
| 5,251,468 | A | 10/1993 | Lin et al. | |
| 6,431,958 | B1 | 8/2002 | Bru-Magniez et al. | |
| 8,119,183 | B2 * | 2/2012 | O'Donoghue | A61F 2/30767 427/180 |
| 2004/0110021 | A1 | 6/2004 | Seth et al. | |
| 2006/0222777 | A1 * | 10/2006 | Skoog | B05B 7/201 427/446 |

FOREIGN PATENT DOCUMENTS

| | | | | |
|---|---|---|---|---|
| GB | 2071521 | A | 9/1981 | |
| SU | 973178 | * | 11/1982 | A61L 33/00 |
| WO | 02102431 | A1 | 12/2002 | |
| WO | 2008033867 | A2 | 3/2008 | |

* cited by examiner

*Primary Examiner* — Dah-Wei D Yuan
*Assistant Examiner* — Andrew Bowman
(74) *Attorney, Agent, or Firm* — Schwabe, Williamson & Wyatt

(57) ABSTRACT

The present application relates to processes for coating surfaces and provides a method of forming a coating on a surface. The method involves bombarding a surface with particles having sufficient energy to remove surface material. At the same time an aerosol is delivered to the surface. The cooperative action of the particles impinging on the surface and the presence of the aerosol contribute to the formation of a coating on the surface.

18 Claims, 12 Drawing Sheets

SURFACE COATING PROCESSES AND USES OF SAME

CROSS REFERENCE TO RELATED APPLICATIONS

This application claims foreign priority benefit from Irish Patent Application Nos. IE2007/0754, IE2007/0753 filed Oct. 16, 2007 which disclosures are incorporated herein by reference.

FIELD OF THE APPLICATION

The present application relates to processes for coating surfaces and the resulting coated surfaces.

BACKGROUND

Processes for treating metal or ceramic surfaces may be divided generally into different categories. These include:

- Processes that modify the physical and or chemical nature of the existing surface
- Processes that remove the existing surface to generate a new surface of different chemical and or physical characteristics
- Processes that generate a new surface by the deposition of materials at the existing surface.

Processes that are employed to modify the chemical nature of the existing surface of devices include, for example, those used to nitride, carburise and carbonitride metallic devices to harden the metal surface in order to make the devices more resistant to abrasive wear. There are currently four principle methods by which titanium, titanium alloys and steels are nitrided. These are plasma nitriding (Rie et al., 1995), ion-beam nitriding (Chen and Juang, 1997), laser nitriding (Xue et al., 1997) and gas nitriding (Gil et al., 2002). The effectiveness of these methods is principally due to the facile diffusion of nitrogen into the titanium and ferrite phases in titanium and steel alloys respectively. The principle methods by which steels (and to a lesser extent titanium and titanium alloys) are carburized are plasma carburising (Dong et al., 2006), gas carburising (Li and Manory, 1995) and vacuum carburising (Chen and Liu, 2003).

Shot peening is a process whereby the physical nature of an existing device surface may be modified. In shot peening solid particulate is propelled at high velocity by means of a carrier fluid either wet or dry, typically water and air respectively, so as to impact the surface of a target substrate typically a metallic substrate. Shot peening has long since been established as a means to induce desirable stress properties in the surfaces of metallic devices wherein the impinging particles act as peening hammers causing a local plastic deformation at the surface rendering it less prone to cracking and corrosion. In addition to the significant pressures, large amounts of thermal energy, instantaneous temperatures as high as 1000° C. have been reported, are also generated locally at the surface in the vicinity of the impact.

Among those processes that modify surface chemistry by the removal of surface material such as, for example, oxides are chemical etching treatments, electro-dissolution treatments, electro-polishing treatments. Also in this category are abrasive processes such as grit blasting and sand blasting treatments. Grit and sand blasting are treatments wherein abrasive hard particles of micrometer dimensions are delivered to the surface at high velocities in fluid streams. The high kinetic energy of these particles results in high temperatures and pressures being generated locally on the device surface upon the particles impacting the surface. This also results in grains at the surface being removed resulting in atoms previously situated in the bulk now being situated at the surface. In a grit blasting process wherein the fluid stream is air and the substrate is of reactive metal, then these atoms formerly situated in the bulk will react rapidly with oxygen so as to form a new oxide layer at the surface.

Processes that deposit new materials at a surface include, for example, Chemical Vapor Deposition (CVD), electroplating, electro-polymerization, sol gel techniques and spray coating. Spray coating is a technique whereby a liquid is atomized and sprayed at a substrate. Usually the atomization process is one whereby high-pressure gas streams are used to disrupt the species to be atomized breaking it into small droplets. These drops are then carried in the gas stream to the surface. Typically the atomized species contains materials to be deposited at the surface as solutes or as suspended particles. These materials adhere to the surface as the carrier liquid evaporates usually through complex chemical coupling agents, such as silane linkages, epoxy linkages and cross-linking agents in the case of polymers, or through curing treatments that incorporate prolonged exposure to heat as for example in the case of sol-gel deposited ceramic coatings.

Shot peening and abrasive processes have been used extensively in surface science as a means to clean and condition surfaces in preparation for further treatments. A shot peening process is known for the simultaneous cleaning and painting of substrates (Kik and Schuurink, 1985). The advantage being that the delay between cleaning and painting is eliminated minimizing re-oxidation of the cleaned metal surface prior to application of the paint. Gruss and Shapiro, 1987 describe a process for the coating of printed circuit boards in which shot peening is employed to clean and condition the surface in preparation for subsequent coatings.

More recently, a number of techniques have been disclosed which use shot peening or abrasive processes as a means to modify the surface chemistry/composition of metallic and other substrates by embedding desired solid material in the surface and these techniques may be broken into three distinct methodologies.

In the first method a single type of single-phase solid particulate is used as the peening or abrasive media. In this method the shattered pieces of the particulate become embedded in the surface of the metal on impact. Such processes are mostly used to embed ceramic materials as the particles must have sufficient hardness size and mass to abrade or peen the surface. Examples include silica, alumina or calcium phosphate ceramics among others as in the patent of Arola and McCain (Arola and McCain, 2003) and that of Kuo (Kuo, 1995).

The second method also involves the use of a single type of solid particle as the peening or abrasive media but the particles themselves are comprised of multiple components usually a hard component that gives the particle mass and density and a softer component that is desired to embed in or attach to the surface on impact. Examples are to be found in (Muller and Berger, 2004; Bru-Maginez et al., 2002; Hisada and Kihira, 2004; Omori and Kieffer, 2000) and in the Rocatek™ bonding system for dental implants.

The third method is to mix different types of solid particulate media, a primary abrasive or peening material and a secondary material desired to embed or augment the surface, in the same fluid stream so that they impinge the surface simultaneously. Examples of this process may be found in (Babecki and Haehner, 1971; Chu and Staugaitis, 1985; Spears, 1988; Vose, 2006; Enbio Ltd. et al., 2008) where such processes are claimed to modify the surface composition of a variety of substrates with a number of materials including plastics, ceramics and metals. WO/2008/033867 teaches the use of grit blasting for the impregnation of metal oxide layers with solid particles delivered to the surface during a standard grit blasting treatment, the disruption caused to the surface oxide by the abrasive action allowing the smaller/softer solid particulate to become entrained in the oxide as it reforms.

These modified shot peening methodologies are limited in their surface modification capabilities for a number of reasons. Firstly the species augmenting the surface chemistry is restricted to solid materials.

In addition the augmented surface layer is a composition containing the embedded particulate and the reformed oxide of the target metal. While this presents the possibility of augmenting the surface layer of metals it is restricted to layers of approximately equal thickness to the native oxide layer on the metal substrate of interest. In many metals such as for example titanium, aluminium and alloys thereof this layer itself may be of the order of nano meters naturally limiting the concentration and nature of the desired particulate that may be incorporated into this thin surface layer.

Furthermore, the solid particulate desired to augment the surface may be in the sub-micron or nanometer size range, the handling of such solid-state particles generating respiratory and other health and safety hazards raises health and safety issues.

SUMMARY

The present application seeks to address these limitations of the prior art and is directed to a coating process for modifying the surface of a variety of substrates. The process comprises the bombardment of surfaces with particles concomitant with the provision of an aerosol at the surface such that antecedent materials provided in the aerosol are transformed into an adhered coating on the surface in co-operation with the bombarding particles. The process is analogous to dynamic compaction on a sub-micron scale. The simultaneous delivery of the aerosol with the bombarding particles which may be from a shot peening or similar process provides for a significant improvement over the prior art.

The antecedent compositions may be gels, suspensions, colloids, solutions of polymeric, organic or inorganic species. The process may be performed at room temperature. Any suitable solvent may be used, including for example, water.

In contrast, previous techniques utilizing shot peening to modify the surface of an article taught only the impregnation of oxide layers. The present application solves many of the problems associated with the prior art. The present application allows the adherence of distinct layers to the article surface.

In addition, health and safety issues are also addressed as the use of an aerosol suppresses the formation of microparticulate dust clouds. Moreover, the problems associated with the fluidisation of sub-micron dry particulate are eliminated. In addition many antecedent compositions, polymer particles in particular, are available supplied as suspensions and the difficulty in obtaining dry particulate matter of the correct physical properties is eliminated.

In one arrangement, the method for forming a coating on a surface comprises the step of bombarding the surface with particles entrained within a gas stream, where the bombarding particles have with sufficient energy to remove material from the surface on impact. One or more of the following may, for example, be employed to bombard the surface: dry shot peening machine, dry blaster, wheel abrader, grit blaster, sand blaster or micro-blaster. The bombarding particles are suitably shot, grit or combinations thereof and may be ceramic, metal, metal alloys, polymer, or combinations thereof. Although, it will depend upon the surface material the bombarding particles may require a kinetic energy of 0.001 Pico-joules or more at the time of reaching the surface to remove material from the surface.

Contemporaneous with bombarding the surface with particles, an aerosol is delivered to the surface. The aerosol may be delivered within the same gas stream as the bombarding particles or within a separate gas stream. The constituents of the aerosol co-operate with the impacting nature of the bombarding particles to form a coating, The antecedent material for the coating may be provided at least in part by one or more of the constituents of the aerosol. Moreover, the coating may be formed entirely from the constituents. In the case where the constituents of the aerosol partially contribute, the bombarding particles and\or other particles may contribute the remaining antecedent coating material. For example, the bombarding particles may have an outer layer of soft material surrounding a hard core, where the outer layer is one of the antecedent materials of the coating. It will be appreciated that the antecedent coating material may not be the same as the resulting coating material since the antecedent material may be transformed as a result of a chemical or other reaction.

The aerosol may be generated by atomizing one or more of the following: a liquid, a solution, a suspension, a gel or sol, and a colloid. The most appropriate one will depend on the nature of coating required and the availability of the coating constituents in a particular form.

The aerosol ma be produced using conventional devices, including for example Bernoulli atomizers, pressure atomisers, two-fluid atomisers, ultrasonic atomisers, modified spray dryers, modified spray coaters, airbrushes, electro spray atomisers, coaxial nozzle assemblies, and coaxial nozzle assemblies operating on the gas lens principle. Generally, such atomiser will employs an atomising gas. By careful selection of the gas delivering the aerosol and the bombarding particles, certain advantages may be obtained. Thus in some circumstances an oxidizing gas may be desirable, whereas in others it would be desirable that the gas(es) were substantially free of oxygen, in which case for example, the gas(es) might comprise: nitrogenous gases including ammonia and nitrogen, inert gases including helium and argon, carbonaceous gas including carbon monoxide, carbon dioxide and hydrocarbons, sulfurous gases including sulfur monoxide, sulfur dioxide and sulfur trioxide, halogen containing gases, and\or hydrogen gas. Thus, for example, a surface may be nitrided prior to or during the formation of the coating.

The method allows for a variety of antecedent materials to be employed to form the coating including, for example, one or more of the following: polymer, ceramic, glass, bio-glass, metal, metal alloy, active agent, monomer, ions, solvent or organo-metallic complexes. In the case of a polymer, the polymer may comprise a thermoplastic, a thermosetting plastic, a biocompatible polymer and\or a biocidal or bacteriostatic polymer In contrast to the prior art, the present method allows for the antecedent coating material to include an active agent. Thus, for example, one or more of the following: a drug, an antibiotic, an anti-restenosis agent, an anti inflammatory, an antithrombotic, a protein, an oligo-peptide, a colloidal metal or organo-metallic, an N-halamine or a quaternary ion may be included within the antecedent coating material and thus are present within the resultant coating.

The coated surface may be subjected to a subsequent treatment to augment the properties of the coating. Such treatments could one or more of the following: dissolution of material out of the coating to augment its morphology, precipitation of material into or onto the coating, particulate bombardment so as to embed particulate in the coating, replenishment of components by ion exchange processes, washing treatments to remove detritus matter and or replenish active agents, and or polarisation treatments including such as electrical or magnetic polarization treatments.

The method are particularly suited to the treatment of the surfaces of medical device and in particular to implantable medical devices. In these cases, the method may render the surface biocidal or bacteriostatic. Similarly, the coating the coating may provide a carrier matrix, in which an active agent may be bonded to, adsorbed or entrained within the carrier matrix. Thus one or more of the following active agents may be provided on the surface of the medical device: anti-restenosis agents, immunosupressants, anti-inflammatory agents, anti-cancer agents, antibiotics, anti-thrombosis agents, proteins, bone morphogenic protein, enzyme, calcium phosphate or oligo-peptides.

The carrier matrix may contains one or more of the following: calcium phosphate, silica, alumina, titania, calcium sulphate, bio-glass, zirconia, stabilised zirconia, the oxide of a lanthanide, sodium bicarbonate or biocompatible polymer.

A further aspect is that employing the methods described herein a biocidal surface may be provided having an adhered polymer coating at least 0.1 microns thick and having a bond-strength with the surface of at least 1.5 MPa. The coating of the biocidal surface may contain one or more of the following: polyamide-imides, polyamides, polyurethanes, polyacrylonitriles, or copolymers of acrylonitriles, polymers having pendant amine, amide or imide groups and wherein the surface is rendered or re-rendered biocidal by exposing the coated surface to halogen containing solutions. The halogen containing solution may be one or more of the following: hypochlorous acid, hypobromous acid, bleach, hypochlorite, perchlorate, hypobromite, perbromate, halogenated aqueous solutions, methylene chloride, methylene bromide or haloalkane solutions.

Yet a further aspect is that a bioactive surface may be provided having an adhered coating at least 0.1 microns thick and having a bond-strength with the surface of at least 1.5 Mpa, the adhered coating comprising a polymer and colloidal metal. In this aspect, the polymer may be chosen from one of the following: polytetrafluoroethylene or polytetrafluoroethylene derivatives, polyethylene, polyacrylics, polycarbonates, polyamides, polyimides or polyurethanes and\or the colloidal metal may be silver, tin, nickel, or combinations thereof. The surface may be biocidal, bacteriostatic or combinations thereof.

In another aspect, an implantable object may be provided having an adhered porous coating comprising a carrier matrix and an active agent wherein the coating is at least 0.1 microns thick and has between 1 picogram and 20 milligrams of active agent per cubic millimeter of coating homogenously distributed in the coating. The carrier matrix for the implantable object may be one or more of the following: calcium phosphate, silica, alumina, titania, titanium dioxide, calcium sulphate, calcium phosphate glass, bio-glass, zirconia, stabilized-zirconia, the oxide of a lanthanide, sodium bicarbonate or biocompatible polymer. Whereas the active agent may be one or more of the following: an anti-restenosis agent, an immunosuppressant, an anti-inflammatory, an anti-thrombosis agent, an antibiotic, an anti cancer agent, a protein, bone morphogenic protein, enzyme, calcium phosphate or oligopeptide.

These and other advantages will become apparent from the description and claims which follow.

BRIEF DESCRIPTION OF THE SEVERAL VIEWS OF THE DRAWING

The application will now be more clearly understood from the following description and the accompanying drawings, in which.

DETAILED DESCRIPTION

Figure 1:
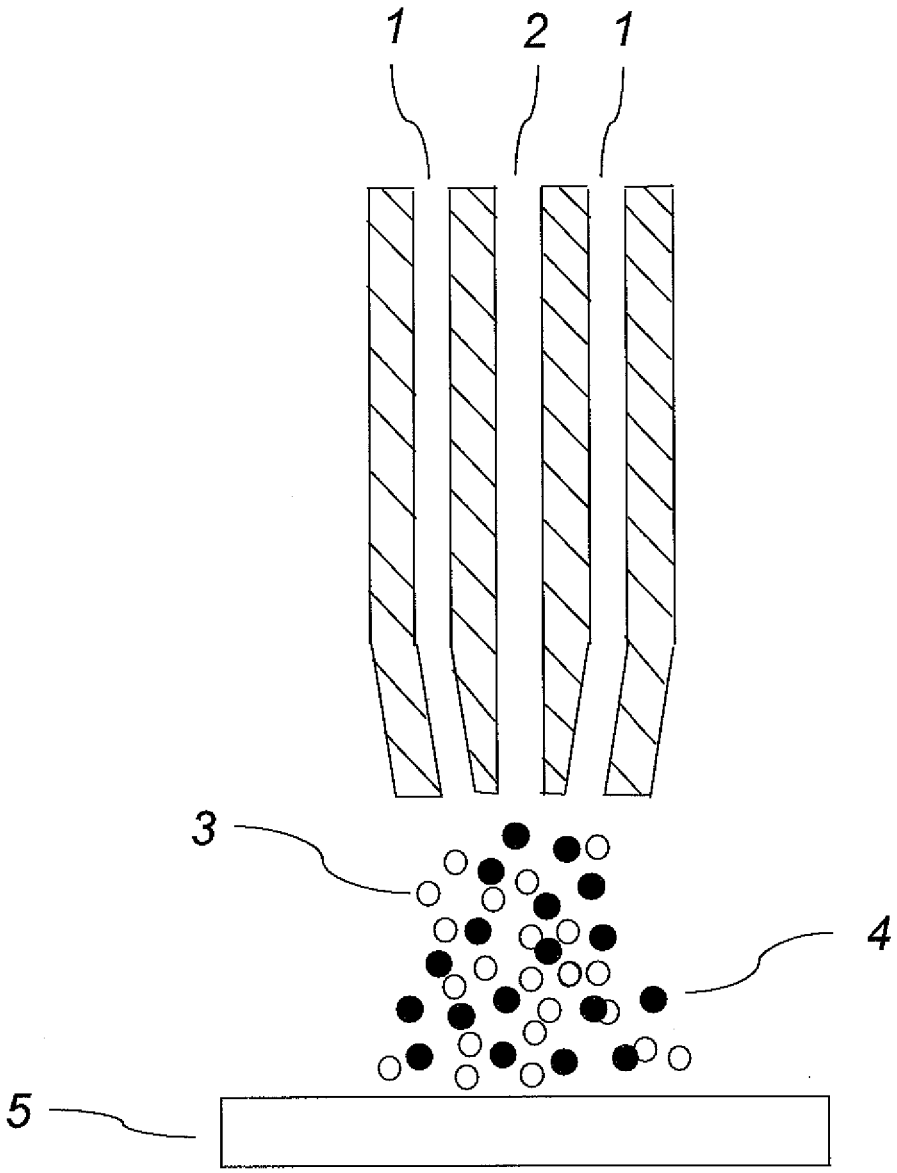
FIG. 1 is a schema of a co-axial nozzle suitable for the simultaneous delivery of the antecedent composition and the primary bombarding particles to surfaces in accordance with a first aspect of the present application.

During grit blasting of metals, surface grains or oxide layers thereon may be removed in their entirety, temporarily exposing un-passivated and highly reactive metal substrate. This exposed surface is highly conducive to chemical reaction and provides one mechanism to modify the surface chemistry of metals during abrasive blasting processes should reactive species be present when this temporary surface state is manifest. Similarly, shot peening is known to induce desirable strain characteristics and or topographies (surface roughness) in metallic surfaces wherein particles of sufficient size, density and velocity impacting the surface cause a local plastic deformation that enhances the mechanical properties of the surface rendering it less vulnerable to stress cracking and corrosion. However the impact of peening or abrasive particles also generate large pressures and thermal energies locally at the impact sites on a surface. Although this energy is dissipated rapidly, the heat and pressure generated by such impacts provides a further potential mechanism to facilitate the reaction of a range of desirable species at surfaces during such processes.

The present application harnesses the transient heat and pressure generated during the bombardment of a surface with sufficiently energetic particles and is directed toward utilizing this energy to facilitate coating the surface in a controlled, safe and effective manner. In particular, a surface to be coated is bombarded with particles while an aerosol is simultaneously provided at the surface. Antecedent materials of the coating so provided at the surface are transformed into an adhered coating by the cooperative action of the impacting particles and the aerosol. The antecedent material may comprise a variety of ingredients including dispersions, sols, gels and\or resins. Advantageously, the antecedent material may also comprise one or more active agents (such as therapeutic drugs and proteins by way of example) and the process is particularly suited to the adherence of active coatings to surfaces.

Thus the present application has use in areas of application including the provision of active coatings for medical devices and biocidal coatings for surfaces generally. Currently, such active coatings are utilized extensively in the medical implant sector wherein active agents such as by way of example anti-restenosis agents or bone morphogenic proteins are adsorbed onto a suitable carrier matrix (typically a polymer or calcium phosphate ceramic) coated on the surface of an implantable medical device. Once implanted, the agents are released from the coating. The agents may serve a variety of biological functions including for example: reduction of smooth muscle cell proliferation or the promotion of osteointegration where the active agents are anti-restenosis agents or bone morphogenic proteins for example and incorporated into coatings used in the drug eluting cardiovascular stent and hard-tissue implants respectively. However the coating methodologies traditionally used in such applications are multi-step processes employing chemical and thermal treatments to adhere suitable carrier matrices to the implant surfaces. In a subsequent step, the carrier matrices are subsequently loaded with the active agent in a separate, usually adsorption, step. In contrast, the present application allows the generation of active coatings at a range of surfaces in a single step process with optimal distribution of the active agent in the coating.

In the present application the energy that facilitates the reaction of the antecedent materials into an adhered coating at the surface is provided by particles impacting the surface. Dynamic compaction is a process that involves the use of an accelerated piston impacting a compact of particulate inorganic material; the pressure and heat generated from the shock wave propagating through the material acting to sinter the particles together (Stuiving a et al., 2002). The present method may be regarded as being analogous to dynamic compaction in the sense that the energy being harnessed is kinetic in origin. However in the present application the energy originates from the impact of particles (as opposed to the single large mass, the piston, in dynamic compaction) and may be readily controlled and tailored by varying the properties of the particles themselves as well as the velocity and density with which they impact the surface.

In order for the antecedent materials to be transformed into a coating sufficient energy must be dissipated at the surface for reaction. This is primarily determined by the mass and velocity of impacting particles i.e their kinetic energy. In the present application a distinction is made between different types of particles on the basis of the function they perform at the surface:

1. Bombarding particles are those particles that strike the surface and dissipate sufficient energy to facilitate reaction of antecedent materials of the coating.
2. Composite bombarding particles comprise an outer layer of antecedent material on a core bombarding particle and serve a dual function: they also strike the surface and dissipate sufficient energy to facilitate reaction of the antecedent materials but in addition provide antecedent material at the surface for reaction by the mechanisms outlined above.
3. Antecedent particles comprise particulate matter that is incorporated into the coating, typically delivered to the surface with insufficient energy to generate any significant pressure or heat examples include low-density materials such as polymers.

Exemplary bombarding particles include those materials traditionally used as shot or grit in shot peening or abrasive processes and may be of ceramic, polymer, metal or compositions thereof. Typically these particles will be of micron or greater dimension and may comprise such materials as silica, alumina, zirconia, titanates, titanium oxide, glass, biocompatible glass, diamond, silicon carbide, boron carbide, tungsten carbide, calcium phosphate ceramics, calcium carbonate, metallic shot, metallic wires, carbon fiber composites, hard polymers, polymeric composites, titanium, stainless steel, hardened steel and chromium alloys among others by way of example.

Composite bombarding particles have previously been disclosed in the prior art including particles comprising a core of hard material and an outer layer that may be ceramic or polymeric in nature. On impact the interface between the outer layer and the core particle is broken, the outer material becoming available for reaction by the mechanisms outlined above. Previously disclosed composite particles comprise outer layer materials that include titanium dioxide, silica, and a range of polymer materials (Muller and Berger, 2004; Bru-Maginez et al., 2002; Hisada and Kihira, 2004; Omori and Kieffer, 2000) and the Rocatek™ bonding system), which disclosures are incorporated herein by reference. Other exemplary outer layer materials may include calcium phosphates, zirconia, calcium phosphate glasses and polymer resins by way of example. These outer layers may further be augmented with active agents.

Generally shot is less abrasive than grit and will have an enhanced pressure/compaction effect when projected at surfaces as compared with irregularly shaped grit. It is therefore more desirable to use regularly shaped, preferably spherical, shot as the bombarding particles in the present application.

Standard equipment may be used as is or with modification in the present application. Particles are readily delivered to surfaces in a gas stream with grit blasters, sand blasters, shot peening machines, micro-blasters and the like and such equipment usually provides for control over the energy with which particles impact a surface. Increasing the velocity with which the bombarding particles strike the surface will result in the generation of higher pressures and temperatures locally at the surface on impact. In addition increasing the density of bombarding particles in the gas flow will increase the flux of compacting particles striking the surface at a given velocity. One of ordinary skill in the art will understand the effect of parameters such as operating pressure, venturi configuration and the like on the energy and density of particles delivered from such equipment. Moreover, it will be appreciated that optimum conditions for a particular application may be determined readily by experiment.

In the present application, the bombarding of particles is combined with the use of an aerosol. The co-operation of the bombarding particles and aerosol is advantageous for a number of reasons:

1. Many desirable materials not readily available in particulate form may be delivered to the surface within the aerosol and formed into coatings including precursor dispersions, sols, gels, resins and suspensions of a vast array of polymer, ceramic and metallic materials.

2. The use of a liquid phase prevents excessive heat generation that would result in the deformation of thin metal substrates such as stents, catheters and the thin metallic casings used in various medical devices or in the degradation of active agents.
3. The liquid phase of the aerosol acts to trap particles that are not adhered to the substrate surface preventing the generation of harmful clouds of particulate matter that may constitute a health hazard.
4. A large amount of flexibility is manifest in the choice of aerosol solvent employed, the solvent may be chosen to suit the particular chemistry of the material being attached to the surface particularly the physio-chemical characteristics of antecedent materials being presented at the surface, (i.e. as solute, suspended particle, gel, resin or sol) is determined primarily by the solubility of the antecedent component in a solvent.

It is worth noting that the use of an aerosol in combination with bombarding particles is advantageous over liquid peening in which particulate is propelled at a surface within a liquid carrier, for example as disclosed in U.S. Pat. No. 6,502,442 (Arola and McCain, 2003) and WO/2008/033867 (Enbio Ltd. et al., 2008). In these processes particles are propelled at the surface at high velocity within a carrier liquid resulting in the impregnation of the surface with the individual particles. The particles so embedded are separated by considerable distance relative to their size and are distributed randomly on the surface and thus these processes do not allow the formation of a continuous coating given that the excessive flux of liquid presents an insufficient density of material at a surface for reaction by the mechanisms outlined above.

In contrast, the use of atomization\aerosol in conjunction with the bombarding particles in the present application allows the formation of such coatings.

Controlling the size and density of droplets in the aerosol is of particular significance in optimising the conversion of antecedent materials into a coating at the surface. Many types of atomizer may be used for the present application. The gas to liquid ratio and flow rates can be controlled in most two-fluid atomizers and those skilled in the art will be aware of the effect of such parameters as venturi design, gas pressures, liquid properties, liquid flow rates and the like on the density and size of droplets produced by such atomizers. Ultrasonic atomizers may also be useful in reducing droplet size. Similarly, the use of volatile organic solvents, hydrocarbons for example, in the liquid phase may be employed.

Control over the composition of the coating may be exercised by varying the concentration of solute, suspended particles or precursors in the atomised liquid phase. This is desirable when costly pharmaceutical agents are to be part of the coating.

A variety of nozzle designs may be employed to deliver the particles and the aerosol to the substrate surface. Similarly, a variety of materials including plastics, metals and ceramics may be used for the nozzle used to deliver the atomised species to the substrate surface. Nozzle(s) used to deliver the particles to the surface will typically comprise a relatively strong material such as ceramic e.g. boron carbide or silicon carbide.

The two principle nozzle configurations that may be used in the present application are:

1. Configurations that deliver the particles and the aerosol to the surface in substantially the same gas flow.
2. Configurations that deliver the particles and the aerosol to the substantially the same region of the surface in multiple gas flows from multiple nozzles.

Configurations in one above include coaxial nozzle configurations and configurations that utilize the carrier gas of the particles to atomise the liquid phase by the Bernoulli effect an example of such a configuration is shown in FIG. 1. A co-axial nozzle is employed, in which the particles (4) are carried within a gas stream in either the inner (2) or outer (1) venturi. The function of the gas stream is two-fold. Firstly, it atomises the liquid phase (3) exiting the other venturi and secondly it carries the particles and the aerosol to the surface (5). Necessarily and depending on the configuration used at least part of the nozzle should be of a hard material such as silicon carbide so as to withstand the abrasive action of the bombarding particles. The nozzle may also incorporate an ultrasonic feature to vibrate the nozzle so as to enhance the atomisation.

Figure 2:
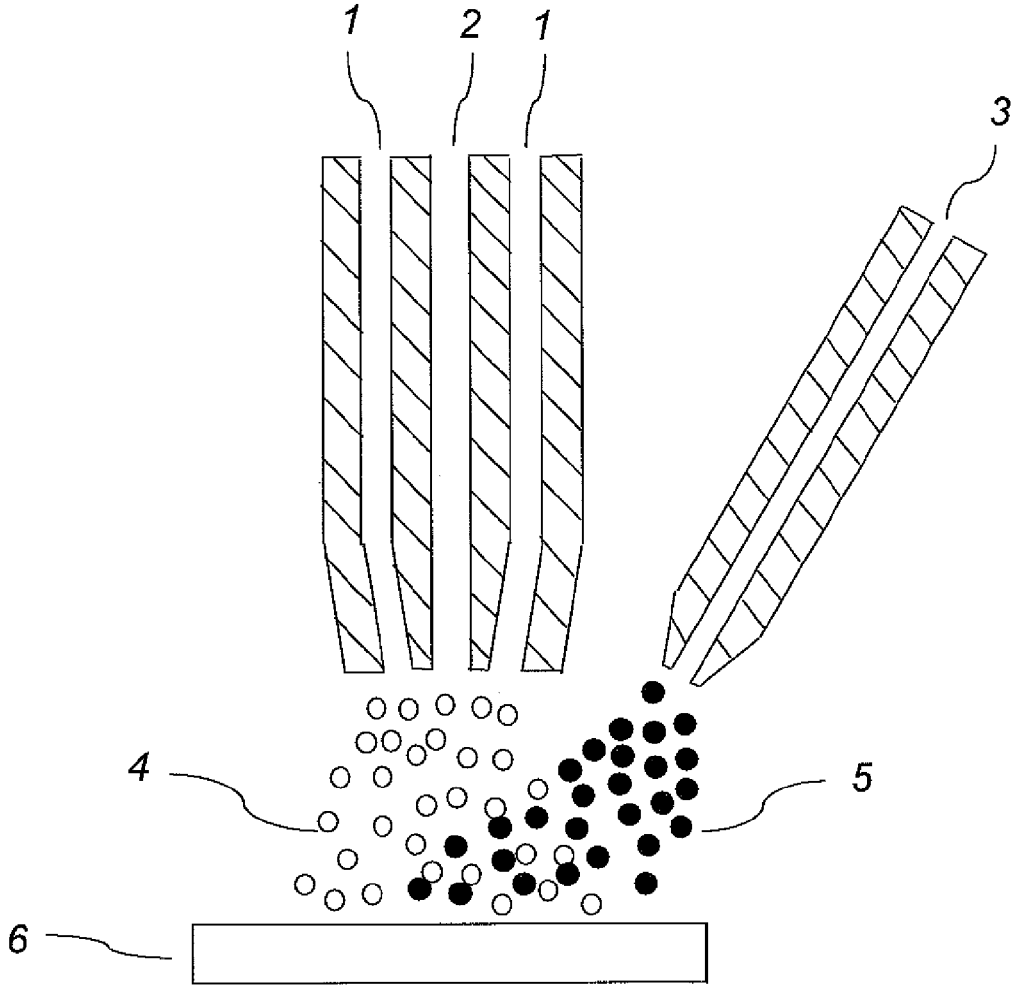
FIG. 2 is a schema of a multiple-nozzle system for the simultaneous delivery of the antecedent composition and the primary bombarding particles to device surfaces.

An example of configuration 2 is shown schematically in FIG. 2 in which separate nozzles are used to deliver particles (5) and the aerosol (4) to the surface (6). The advantage of separate nozzles is that standard nozzles used with shot peening equipment (3) and\or standard atomizers may be employed. In addition the atomizer nozzle arrangement may comprise a coaxial nozzle comprised of an inner (2) and outer (1) venturi through which the liquid phase and an atomizing gas may be delivered respectively.

Other exemplary nozzle systems for generating the aerosol include those that direct a gas stream over a venturi connected to a liquid reservoir atomizing by the Bernouli effect. Another possible nozzle configuration is one where a liquid stream is ejected from a nozzle and atomised by gas jets either side of the liquid stream. Pre-filming nozzles whereby a capillary deposits a thin film of liquid at a standard nozzle tip may be utilised to generate small droplets (Nguyen and Rhodes, 1998). Ultrasonics may be incorporated into the nozzle designs to assist with atomisation. Yet another type of nozzle is of the type whereby a gas lens is used to focus a liquid stream for the creation of small droplets (Ganan-Calvo, 2001). All these nozzles may also be preceded by an internal mixer (Nguyen and Rhodes, 1998) whereby the liquid is atomised in a chamber prior to being expelled from the nozzle so as to decrease the droplet size. The content of these disclosures is hereby incorporated by reference.

In general the nozzle assembly used in the present application may be configured in an automated fashion to follow the contours of a surface using readily available automation equipment and computer numerical control (CNC) software. Those skilled in the art will be aware of how various automation components such as motors, stepper-motors, multiple-axis robots and the like may be combined in conjunction with CNC software to automate the movement of a nozzle assembly. Alternatively, it will be appreciated that the nozzles may be fixed and the movement of the surface similarly automated.

It will further be appreciated that the thickness of the coating may be controlled by the speed and repetition with which such nozzle assemblies traverse the surface.

In addition such automation may be provided in a controlled environment such as in a chamber or cabinet isolated from the general surroundings. In certain applications it may be advantageous that such environs approximate a clean room environment, particularly where the surface being coated is for use in a medical setting. Those skilled in the art will be aware of how components such as air-filters, hepa-filters, ultraviolet sterilizers, other sterilization equipment and the like may be incorporated into such chambers or cabinets.

It may also be advantageous that such cabinets or chambers be connected to pumping systems to remove the byproducts of the process, blasting particles, liquid and the like, and deliver them to suitable waste storage vessels.

Such environments may also incorporate temperature control and those skilled in the art will appreciate how the relationship between the temperature of the environment and the liquid phase employed in atomization may influence dropsize in the aerosol being provided at the surface.

A further feature of the present technique is that the environment at the surface may be controlled by careful selection of the gases for the aerosol and\or delivery of the particles. In particular, the gases employed in the present application may be used to induce desirable properties in the surface in addition to delivering the particles and aerosol, particularly where the surface being coated is metallic. This is achieved by employing gases that are substantially free of oxygen as the carrier for the particulate and as the atomizing gas. The carrier gas may react with the surface facilitated by the mechanisms outlined above to create a passive layer of metal salts. Where the gas stream is nitrogenous and reducing in nature (e.g. of nitrogen) the metal surface may be nitrided. Where the gas stream is carbonaceous and reducing in nature (e.g. of carbon monoxide in an inert gas such as argon) the metal surface may be carburized. Where the gas stream is a mixture of nitrogenous and carbonaceous gases (e.g. of carbon monoxide and nitrogen in argon) the metal surface is carbonitrided. Thus metal surfaces may be coated while the underlying metal is simultaneously hardened and\or passivated.

The technique of the present application may be used to form a vast array of polymeric, inorganic and metallic species into coatings at surfaces that may advantageously be augmented with or incorporate active agents of varying types, providing an adhered active coating on a surface, where the coating incorporates a carrier matrix and an active agent. The active agent may be bonded to or adsorbed on a component of the carrier matrix or simply be entrained within it. The carrier matrix may be of ceramic, glass, metal, polymer or combinations thereof. In addition the polymers may be biocompatible, antibacterial or naturally occurring biopolymers. In certain applications it would be desirable that the ceramic, metal or glass be biocompatible.

It will be appreciated that a wide variety of polymer materials may be employed as part of or indeed as the antecedent material to form the coating. Exemplary antecedent polymer materials may include particulate, solutions, gels, sols and resins of Acrylics, poly(acrylic acid), Poly(acrylic acid, sodium salt), poly(methylmethacrylate) (PMMA), poly(methylacrylate) (PMA), poly(hydroxyethyl methacrylate) (HEMA), poly(acrylonitrile), acrylonitrile (PBAN), Sodium polyacrylate, polyacrylamide (PAM), Ethylene N-Butyl Acrylate, Polyethyleneglycol methyl ether methacrylate, Poly(acrylic acid) partial sodium salt-graft-poly(ethylene oxide), Poly(acrylic acid-co-maleic acid), Poly(acrylonitrile-co-butadiene-co-acrylic acid) dicarboxy terminated, Poly (acrylonitrile-co-butadiene-co-acrylic acid), dicarboxy terminated glycidyl methacrylate diester, Poly(ethylene-co-acrylic acid), Poly(ethylene-co-methyl acrylate-co-acrylic acid), Poly(2-ethylacrylic acid), Poly(2-propylacrylic acid), Poly(propylene glycol) methacrylate, Poly(propylene glycol) methyl ether acrylate, Poly(propylene glycol) 4-nonylphenyl ether acrylate, Poly(acrylic acid-co-acrylamide) potassium salt, Poly(N-isopropylacrylamide), Poly(acrylamide-co-acrylic acid), Acrylic Copolymers, any other polyarylate; polycarbonates, polycarbonate, polyestercarbonate; polyvinyls, poly(vinyl ethers), Poly(methyl vinyl ether), poly(vinyl alcohols), ethylene vinyl alcohol, Poly(ethylene glycol)-block-poly(propylene glycol)-blockpoly(ethylene glycol), Poly(vinyl alcohol-co-ethylene), Poly(vinyl alcohol-co-vinyl acetate-co-itaconic acid), Poly(vinyl chloride-co-vinyl acetate-co-vinyl alcohol), Poly(vinyl butyral-co-vinyl alcohol-co-vinyl acetate), Poly(4-vinylphenol), poly(vinyl ketones), poly(vinyl nitriles), poly(vinyl esters), poly(vinyl acetate), poly ethylene vinyl acetate, poly(vinyl pyridines), poly(2-vinyl pyridine), poly(5-methyl-2-vinyl pyridine), Poly(4-vinylpyridine), Poly(4-vinylpyridine-co-styrene), Polyvinylpyrrolidone, Polyvinylchlorides, polyvinylchloride, Polyvinylidene chloride, Poly(vinylbenzyl chloride), Poly(vinylidene fluoride), ethylenevinyl co-polymers; Polystyrenes, Polystyrene (PS), Acrylonitrile butadiene styrene (ABS), High impact polystyrene (HIPS), Extruded polystyrene (XPS), Expandable Polystyrene Bead, poly(sodium styrene sulfonate), any other polystyrene; polydienes, polybutadiene; Polyamides, Polyamide (PA), poly(polyphthalamide) (PPA), Polyphthalamide, poly(bismaleimide) (BMI), poly (urea formaldehyde) (UF), polyurea, nylons, amorphous nylon, nylon Type 11, nylon Type 12, nylon Type 46, nylon Type 6, nylon Type 6/66 Copolymer, nylon Type 610, nylon Type 66, nylon Type 69, Nylon/Polypropylene Alloy, Poly glutamic acid, Aramids, meta aramids, para-aramids, kevlar, poly-metaphenylene isophtalamides, poly p-phenylene terephtalamides, Technora, Sulfron 3000, Cyamelide, Sodium poly(aspartate), any other polyamide; Polyamide-Imides; Polyester-imides; Polyarylethers; Polyaryletherketone; Polysulfones, Polysulfone (PSU), Polyarylsulfone (PAS), Polyethersulfone (PES), Polyphenylsulfone (PPS), Poly(1-decene-sulfone), Poly(1-dodecene-sulfone), Poly(1-hexadecene-sulfone), Poly(1-hexene-sulfone), Poly(1-octene-sulfone), Poly(1-tetradecene-sulfone), any other polysulfone; Polyesters, Polyethylene terephthalate (PET), polybutyrate, alkyds, Capilene, Glycerine phthalate, Polybutylene terephthalate, Polycaprolactone, Polydioxanone, Polyethylene naphthalate, Polyglycolide, Polyhydroxyalkanoates, poly-beta-hydroxybutyrate, polyhydroxybutyrate-valerate, Polyhydroxybutyrate, polyhydroxyvalerate, polyhydroxyhexanoate, polyhydroxyoctanoate, polylactic acid, Polytrimethylene terephthalate, poly diallyl isophthalate, poly diallyl phthalate; Polyacrylamides; Polyketones, Polyetheretherketone (PEEK), Polyetherketone (PEK), any other polyketone; Polyetherimides; Polyalkenes; Polyimides; Fluoropolymers, polytetrafluoroethylene (PTFE, Teflon), poly perfluoroalkoxy polymer resin (PFA), poly fluorinated ethylene-propylene (FEP), Poly Ethylene TetrafluoroEthylene (ETFE, Tefzel, Fluon), Polychlorotrifluoroethylene, (ECTFE, Turcite, Haler), PolyVinylidine DiFluoride (PVDF, Kynar), FFKM (Kalrez, Tecnoflon FFKM), FKM (Viton, Tecnoflon), Poly(hexafluoropropylene oxide), Poly(perfluoropropylene-oxide-co-perfluoroformaldehyde), Polychlorotrifluoroethylene, any other fluorinated polymer; polyurethanes, Polyurethane (PU), Polyisocyanurate (PIR), any other polyurethane; polyolefins, Polyethylene (PE), Low density polyethylene (LDPE), High density polyethylene (HDPE), Crosslinked polyethylene (XLPE), Polypropylene (PP), Polybutylene (PB), Polymethylpentene, Polyisobutene, (PIB) Biaxially-oriented polypropylene, Expandable Polyolefin Bead, tyvek, poly-(ethylene oxamide-N,N'-diacetate), complexes of poly-(ethylene oxamide-N,N'-diacetate) with metal ions, any other polyolefin; Polyepoxides; polyethers, poly ether ether ketone, polydioxanone, polyethylene glycol, Poly(hexafluoropropylene oxide), polyoxymethylene, polyethylene glycol, techron, Phenylene Ether/Oxide (PPO/PPE) Based Resins; Poly(allylamine); Polyphenylene Sulfide (PPS); Polycondensates having nitrogen-containing heterocyclic rings in the main chain; Polyhydrazides; Polytriazoles; Polyamino-triazoles; Polyoxadiazoles; Polythiophenes; polyaniline; polyphenols; Poly(tetrahydrofuran); Ionomers; Spectralon thermoplastic resin; Liquid Crystal Polymers; Plasticisols; Organosols; DCPD Resin; Furan; Melamine;

Silicones; cationic polymers, poly(4-hydroxy-L-proline ester), Poly(γ-(4-aminobutyl)-L-glycolic acid), poly(amino esters), cystamine bisacrylamides, poly(amido amine)s, polyurethanes containing poly(ethylene glycol) in the backbone, poly(L-lysine)s, poly(L-lysine)-poly(ethylene glycol)-poly(lactic-co-glycolic acid) hybrid polymers, poly(L-lysine)-poly(ethylene glycol) block co-polymers, poly (ethylene imine), poly(phosphazenes), poly(phosphoesters), poly(phosphoramidates), phosphorylcholine, poly(glycolode), poly(glycolide), poly(lactic acid), poly(L-lactide), poly(D,L-lactide), poly(caprolactone), poly(anhydride), poly (alkylcyanoacrylate), poly(ethyl-2-cyanoacrylate), poly(butylcyanoacrylate), poly(hexylcyanoacrylate), poly(octylcyanoacrylate), Polycaprolactone diol, poly(lactide-co-glycolide), poly(D,L-lactide-co-glycolide), poly(lactide-co-caprolactone), poly(2-ethyl-2-oxazoline)-block-poly (caprolactone), poly(ethylene oxide)-poly(DL-lactic-co-glycolic acid) co-polymer, Poly(L-lactide-co-caprolactone-co-glycolide), Poly(DL-lactide-co-glycolide), Poly[(R)-3-hydroxybutyric acid], Poly(1,4-butylene adipate-co-polycaprolactam), Poly(DL-lactide-co-caprolactone), Poly (3-hydroxybutyric acid-co-3-hydroxyvaleric acid), Poly(1,4-butylene adipate-co-1,4-butylene succinate), extended with 1,6-diisocyanatohexane, Poly(1,4-butylene succinate), extended with 1,6-diisocyanatohexane, Nylon 6, poly(ethylene glycol), poly(propylene glycol), poly(ethylene glycol) based polymers, Di[poly(ethylene glycol)]adipate, Poly(propylene glycol) bis(2-aminopropyl ether), Poly(propylene glycol), tolylene 2,4-diisocyanate terminated, Poly(propylene glycol) diglycidyl ether, Poly(propylene glycol) monobutyl ether, Hexaethylene glycol, Pentaethylene glycol, Polyethylene-block-poly(ethylene glycol), Poly(ethylene glycol) acrylate, Poly(ethylene glycol) bis(3-aminopropyl) terminated, Poly(ethylene glycol) bis(carboxymethyl)ether, Poly(ethylene glycol) butyl ether, Poly(ethylene glycol) diacrylate, Poly(ethylene glycol) dimethacrylate, Polyethylene glycol dimethyl ether, Polyethylene glycol distearate, Poly (ethylene glycol) divinyl ether, Poly(ethylene glycol) ethyl ether methacrylate, Poly(ethylene glycol) 2-[ethyl[(heptadecafluorooctyl)sulfonyl]amino]ethyl ether, Poly(ethylene glycol) 2-[ethyl[(heptadecafluorooctyl)sulfonyl]amino]ethyl methyl ether, Poly(ethylene glycol), a-maleimidopropionamide-formyl Terminated, Poly(ethylene glycol) methacrylate, Poly(ethylene glycol) methyl ether, Poly(ethylene glycol) methyl ether-block-poly(ϵ-caprolactone), Poly(ethylene glycol) methyl ether-block-polylactide, Poly(ethylene glycol) methyl ether methacrylate, Poly(ethylene glycol) myristyl tallow ether, Poly(ethylene glycol) 4-nonylphenyl ether acrylate, Poly(ethylene glycol) phenyl ether acrylate, Poly (ethylene glycol) reacted with Bisphenol A diglycidyl Ether, Poly(ethylene glycol) tetrahydrofurfuryl ether, Poly(ethylene oxide), Poly(ethylene oxide)-block-polycaprolactone, four-arm, Poly(ethylene oxide)-block-polylactide, four-arm, Poly (ethylene oxide) four-arm amine terminated, carboxylic acid terminated, hydroxyl terminated, succinimidyl glutarate terminated, succinimidyl succinate terminated, thiol terminated, Poly(ethylene oxide) six arm hydroxyl terminated, Tetraethylene glycol dimethyl ether, Poly(ethylene glycol)-poly(propylene glycol) co-polymers, Poly(ethylene glycol)-block-poly(propylene glycol)-blockpoly(ethylene glycol), Poly (ethylene glycol-ran-propylene glycol), Poly(ethylene glycol-ran-propylene glycol) monobutyl ether, Poly(propylene glycol)-block-poly(ethylene glycol)-blockpoly(propylene glycol), Poly(propylene glycol)-block-poly(ethylene glycol)-blockpoly(propylene glycol) bis(2-aminopropyl ether), Poly(isobutylene-co-maleic acid), Lignosulfonic acid sodium salt, Poly[(isobutylene-alt-maleic acid), ammonium salt)-co-(isobutylene-alt-maleic anhydride)], Poly(isobutylene-alt-maleic anhydride), Poly[(isobutylene-alt-maleimide)-co-(isobutylene-alt-maleic anhydride)], Poly(methyl vinyl ether-alt-maleic anhydride), The method of claim 91 wherein the biopolymers are of, but not limited to: polysaccharides, starch, Algal starch, glycogen, cellulose based biopolymers, cellulose acetates, cellulose ethers, cellulose acetate, cellulose acetate butyrate, cellulose acetate propionate, ethyl cellulose, cellulose propionate, cellulose acetate phthalate, methyl cellulose, hydroxy ethyl cellulose, hydroxypropyl methyl cellulose, carboxymethylcellulose, (Acrylamidomethyl)cellulose acetate butyrate, (Acrylamidomethyl) cellulose acetate propionate, Cellulose acetate trimellitate, Cellulose, cyanoethylated, Cellulose nitrate, Cellulose powder, Cellulose triacetate, Hydroxyethylcellulose ethoxylate quaternized, 2-Hydroxyethyl cellulose hydrophobically modified, 2-Hydroxyethyl starch, Hydroxypropyl cellulose, (Hydroxypropyl)methyl cellulose, Hydroxypropyl methyl cellulose phthalate, Methyl 2-hydroxyethyl cellulose, Sodium carboxymethyl cellulose, chitin, chitosan, chitosan oligosaccharide lactate, pectin, acidic polysaccharides, xanthan gum, dextran, gellan gum, pullulan, carrageenan, chondrotin, Dextrin palmitate, Maltodextrin, agar, Alginic acid sodium salt; gelatine; collagen; alginate; hyaluronic acid; alginic acid; resins; polyenes; gums; proteins; polypeptides; nucleic acids; poly-3-hydroxybutyrate; Cutin or combinations and copolymers of the above.

Similarly exemplary antecedent ceramic, metal and glass materials include particulate, solutions, suspensions, gels, sols and colloids of oxides, nitrides, nitrates, carbides, carbonates, sulfates, halides and phosphates. Such antecedent compositions may also comprise organo-metallics including the carboxylates, alkoxides and esters of metals particularly those of calcium, phosphorous, titanium, silicon, aluminum, sulfur, nickel, vanadium, zirconium, yittrium, precious metals and the lanthanides.

A suitable application of the process of the present application is directed toward adhering active coatings to implantable medical devices. In such applications the coating is comprised of a biocompatible carrier matrix and an active agent. Active agents that may be included in the antecedent composition and ultimately the coating, include: antibiotics, anti-restentosis agents, immunosupressants, anti-inflammatory agents, hypolipidemic agents, anti-thrombosis agents, proteins, oligopeptides and the like.

Active agents that may be incorporated are by way of example Aminoglycosides, Amikacin, Gentamicin, Kanamycin, Neomycin, Netilmicin, Streptomycin, Tobramycin, Paromomycin, Ansamycins, Geldanamycin, Herbimycin, Carbacephem, Loracarbef, Carbapenems, Ertapenem, Doripenem, Imipenem/Cilastatin, Meropenem, Cephalosporins, first generation cephalosporins, Cefadroxil, Cefazolin, Cefalotin, Cefalexin, second generation cephalosporins, Cefaclor, Cefamandole, Cefoxitin, Cefprozil, Cefuroxime, third generation cephalosporins, Cefixime, Cefdinir, Cefditoren, Cefoperazone, Cefotaxime, Cefpodoxime, Ceftazidime, Ceftibuten, Ceftizoxime, Ceftriaxone, Cefdinir, fourth generation cephalosporins, Cefepime, Glycopeptides, Teicoplanin, Vancomycin, Dalbavancin, Telavancin, Macrolides, Azithromycin, Clarithromycin, Dirithromycin, Erythromycin, Roxithromycin, Troleandomycin, Telithromycin, Spectinomycin, Monobactams, Aztreonam, Penicillins, Amoxicillin, Ampicillin, Azlocillin, Carbenicillin, Cloxacillin, Dicloxacillin, Flucloxacillin, Mezlocillin, Meticillin, Nafcillin, Oxacillin, Penicillin, Piperacillin, Ticarcillin, Polypeptides, Bacitracin, Colistin, Polymyxin B, Quinolones, Ciprofloxacin, Enoxacin, Gatifloxacin, Levofloxacin, Lomefloxacin, Moxifloxacin, Norfloxacin, Ofloxacin, Trovafloxacin, Sulfonamides, Prontosil, Sulfacetamide, Sulfamethizole, Sulfanilimide, Sulfasalazine, Sulfisoxazole, Trimethoprim, Trimethoprim-Sulfamethoxazole (Co-trimoxazole) (TMP-SMX), Tetracyclines, Doxycycline, Vibramycin, Minocycline, Minocin, Oxytetracycline, Terracin, Tetracycline, arylmorpholinoacids (AMPAs), S-arylmorpholinoacids, N-methyl AMPA, N,N-dimethyl AMPA, Arsphenamine, Chloramphenicol, Clindamycin, Lincomycin, Ethambutol, Fosfomycin, steroid antibiotics, Fusidic acid, Furazolidone, Isoniazid, Linezolid, imidazole derivatives, Metronidazole, Timidazole, ornidazole, nitrofuran derivatives, nitrofurantoin, nifurtoinol, Mupirocin, Nitrofurantoin, Platensimycin, Pyrazinamide, Quinupristin/Dalfopristin, Rifampicin, Polymyxins, colistin, polymyxin B, xibornol, clofoctol, methenamine, mandelic acid, Nitroxoline, daptomycin, Hitachimycin; antivirals, Interferons, Entry inhibitors, Maraviroc, Enfuvirtide, Epigallocatechin gallate, Griffithsin, Integrase inhibitors, Protease inhibitors, Saquinavir, Ritonavir, Indinavir, Nelfinavir, Amprenavir, Lopinavir, Atazanavir, Fosamprenavir, Tipranavir, Darunavir, Nucleoside analogues, deoxyadenosine analogues, Didanosine, Vidarabine, deoxycytidine analogues, Cytarabine, Emtricitabine, Lamivudine, Zalcitabine, deoxyguanosine analogues, Abacavir, (deoxy-) thymidine analogues, Stavudine, Zidovudine, deoxyuridine analogues, Idoxuridine, Trifluridine, Reverse transcriptase inhibitors, Nucleoside analog reverse transcriptase inhibitors, Zidovudine, Didanosine, Zalcitabine, Stavudine, Lamivudine, Abacavir, Emtricitabine, Nucleotide analog reverse transcriptase inhibitors, Tenofovir, Adefovir, Non-nucleoside reverse transcriptase inhibitors, Efavirenz, Nevirapine, Delavirdine, Etravirine, portmanteau inhibitors, Aciclovir, Acyclovir, Amantadine, Arbidol, Atripla, Brivudine, Cidofovir, Combivir, Docosanol, Edoxudine, Enfuvirtide, Enfuvirtide, Famciclovir, Fomivirsen, Foscarnet, Fosfonet, Ganciclovir, Gardasil, Ibacitabine, Immunovir, Imiquimod, Inosine, Loviride, MK-0518, Maraviroc, Moroxydine, Nexavir, Oseltamivir, Penciclovir, Peramivir, Pleconaril, Podophyllotoxin, Ribavirin, Rimantadine, Tenofovir disoproxil, Trizivir, Tromantadine, Truvada, Valaciclovir, Valganciclovir, Vicriviroc, Viramidine, Zanamivir; synergistic enhancers of antiretrovirals, Chloroquine/quinoline antimalarials, Hydroxyurea, Leflunomide, Mycophenolic acid, Resveratrol, Ritonavir; antifungals, Polyene antifungals, Natamycin, Rimocidin, Filipin, Nystatin, Amphotericin B, Imidazole and triazole antifungals, Miconazole, Ketoconazole, Clotrimazole, Econazole, Bifonazole, Butoconazole, Fenticonazole, Isoconazole, Oxiconazole, Sertaconazole, Sulconazole, Tioconazole, Fluconazole, Itraconazole, Isavuconazole, Ravuconazole, Posaconazole, Voriconazole, Terconazole, Allylamines, Terbinafine, Amorolfine, Naftifine, Butenafine, Echinocandins, Anidulafungin, Caspofungin, Micafungin, Benzoic Acid combined with a keratolytic agent, Ciclopirox, Flucytosine, Griseofulvin, Gentian Violet, Haloprogin, Tolnaftate, Undecylenic acid, Tea tree oil, Citronella oil, lemon grass, orange oil, palmarosa oil, patchouli, lemon myrtle, Neem seed oil, coconut oil; antiparasitics, Antinematodes, Mebendazole, Pyrantel pamoate, Thiabendazole, Diethycarbazine, Anticestodes, Niclosamide, Praziquantel, Antitrematodes, Praziquantel, Antiamoebics, Rifampin, Amphotericin B, Antiprotozoal, Melarsoprols, mono and di alkylating agents, nitrogen mustards, chlorambucil, chlormethine, cyclophosphamide, ifosfamide, melphalan, uramustine, mechlorethamine, nitrosoureas compounds, carmustine, fotemustine, lomustine, streptozocin, platinum compounds, carboplatin, cisplatin, oxaliplatin, BBR3464, satraplatin, busulfan, dacarbazine, procarbazine, temozolomide, thioTEPA, treosulfan, hexamethylmelamine; antimetabolites, folic acid analogues, aminopterin, methotrexate, pemetrexed, raltitrexed, trimethoprim, pyrimethamine, purine analogues, cladribine, clofarabine, fludarabine, fludarabine phosphate, mercaptopurine, pentostatin, thioguanine, azathioprine, pyrimidine analogues, capecitabine, cytarabine, fluorouracil, 5-fluorocil, floxuridine, gemcitabine, daunorubicin, doxorubicin, epirubicin; plant alkaloids, vinca alkaloids, vinblastine, vinblastine sulphate, vincristine, vincristine sulphate, vindesine, vinorelbine, podophyllotoxin, taxanes, docetaxel, paclitaxel, Abraxane, 7-deoxytaxol, 10-deacetoxytaxol, paclitaxel analogs with ortho and meta-substituted aroyl substituents and all other paclitaxel derivatives; terpenoids; topoisomerase inhibitors, inhibitors of the topoisomerase I and topoisomerase II enzymes, irinotecan, topotecan, camptothecin and lamellarin D, amsacrine, etoposide, etoposide phosphate, teniposide and doxorubicin, fluoroquinolones; cytoxic/antitumour antibiotics, idarubicin, mitoxantrone, pixantrone, valrubicin, actinomycin, bleomycin, mitomycin, mitomycin-C, plicamycin, hydroxyurea, dactinomycin; monoclonal antibodies, cetuximab, panitumumab, trastuzumab, rituximab, tositumomab, alemtuzumab, bevacizumab, gemtuzumab; tyrosine kinase inhibitors, cediranib, dasatinib, erlotinib, gefitinib, imatinib, lapatinib, nilotinib, sorafenib, sunitinib, vandetanib; photosensitizers, aminolevulinic acid, methyl aminolevulinate, porfimer sodium, verteporfin; retinoids, alitretinoin, tretinoin; other anti-tumour agents, altretamine, amsacrine, anagrelide, arsenic trioxide, asparaginase (pegaspargase), bexarotene, bortezomib, denileukin diftitox, estramustine, ixabepilone, masoprocol, mitotane, testolactone, helenalin; glucocorticoids, cortisone, cortisol, alclometasone, amcinonide, beclometasone, betamethasone, budesonide, ciclesonide, clobetasol, clobetasone, clocortolone, cloprednol, cortivazol, deflazacort, deoxycorticosterone, desonide, desoximetasone, dexamethasone, diflorasone, diflucortolone, difluprednate, fluclorolone, fludrocortisone, fludroxycortide, flumetasone, flunisolide, fluocinolone acetonide, fluocinonide, fluocortin, fluocortolone, fluorometholone, fluperolone, fluprednidene, fluticasone, formocortal, halcinonide, halometasone, hydrocortisone aceponate, hydrocortisone buteprate, hydrocortisone butyrate, loteprednol, medrysone, meprednisone, methylprednisolone, methylprednisolone aceponate, mometasone furoate, paramethasone, prednicarbate, prednisone, prednisolone, prednylidene, rimexolone, tixocortol, triamcinolone, ulobetasol and all derivatives of said glucocorticoids; antibodies, polyclonal antibodies, monoclonal antibodies, T-cell receptor directed monoclonal antibodies, IL-2 receptor monoclonal antibodies, infliximab, basiliximab, abciximab, daclizumab, palivizumab, etanercept, cetuximab, panitumumab, trastuzumab, rituximab, tositumomab, alemtuzumab, bevacizumab, gemtuzumab, TNF inhibitors, adalimumab, certolizumab pegol, afelimomab, aselizumab, atlizumab, atorolimumab, belimumab, bertilimumab, cedelizumab, clenoliximab, dorlimomab aritox, dorlixizumab, eculizumab, efalizumab, elsilimomab, erlizumab, faralimomab, fontolizumab, galiximab, gantenerumab, gavilimomab, golimumab, gomiliximab, ibalizumab, inolimomab, ipilimumab, kelximab, lebrilizumab, lerdelimumab, lumiliximab, maslimomab, mepolizumab, metelimumab, morolimumab, muromonab-CD3, natalizumab, nerelimomab, ocrelizumab, odulimomab, omalizumab, otelixizumab, pascolizumab, pexelizumab, reslizumab, rovelizumab, ruplizumab, siplizumab, talizumab, telimomab aritox, teneliximab, teplizumab, tocilizumab, toralizumab, vapaliximab, vepalimomab, visilizumab, zanolimumab, ziralimumab, zolimomab aritox, directed human antibodies, murine antibodies, humanised antibodies, chimeric antibodies; drugs acting on immunophilins, cyclosporine, tacrolimus, sirolimus; interferons, IFN-β, IFN-γ; opioids, natural opioids, morphine, codeine, thebaine, papaverine, noscapine, oripavine, semi-synthetic opioids, hydromorphone, hydrocodone, oxycodone, dihydrocodeine, nicomorphine, oxymorphone, synthetic opioids, Anilidopiperidines, Fentanyl, Alfentanil, Sufentanil, Remifentanil, Carfentanyl, Ohmefentanyl, Phenylpiperidines, Pethidine, Ketobemidone, Allylprodine, prodine, Diphenylpropylamine derivatives, Propoxyphene, Dextropropoxyphene, Dextromoramide, Bezitramide, Piritramide, Methadone, Dipipanone, Levo-alphacetylmethadol, Loperamide, Diphenoxylate, Benzomorphan derivatives, Pentazocine, Phenazocine, Oripavine derivatives, Buprenorphine, Etorphine, Morphinan derivatives, butorphanol, nalbuphine, levorphanol, levomethorphan, Dezocine, Lefetamine, Meptazinol, Tilidine, Tramadol, Tapentadol, Nalmefene, Naloxone, Naltrexone, endogenous opioids; other immunosuppressant agents, beta-2'-deoxythioguanosine, bisantrene HCl, bleomycin sulfate, buthionine sulfoximine, BWA 773U82, BW 502U83.HCl, BW 7U85 mesylate, ceracemide, carbetimer, chloroquinoxaline-sulfonamide, chlorozotocin, chromomycin A3, corticosteroids, *Corynebacterium parvum*, CPT-11, crisnatol, cyclocytidine, cytembena, dabis maleate, deazauridine, dexrazoxane, dianhydrogalactitol, diaziquone, dibromodulcitol, didemnin B, diethyldithiocarbamate, diglycoaldehyde, dihydro-5-azacytidine, echinomycin, edatrexate, edelfosine, eflornithine, Elliott's solution, elsamitrucin, esorubicin, estramustine phosphate, estrogens, etanidazole, ethiofos, fadrazole, fazarabine, fenretinide, filgrastim, finasteride, flavone acetic acid, 5-fluorouracil, Fluosol®, flutamide, gallium nitrate, gemcitabine, goserelin acetate, hepsulfam, hexamethylene bisacetamide, homoharringtonine, hydrazine sulfate, 4-hydroxyandrostenedione, hydrozyurea, interferon alfa, interferon beta, interferon gamma, interleukin-1 alpha and beta, interleukin-3, interleukin-4, interleukin-6, 4-ipomeanol, iproplatin, isotretinoin, leucovorin calcium, leuprolide acetate, levamisole, liposomal daunorubicin, liposome encapsulated doxorubicin, lonidamine, maytansine, menogaril, merbarone, mesna, methanol extraction residue of *Bacillus* calmette-guerin, N-methylformamide, mifepristone, mitoguazone, monocyte/macrophage colony-stimulating factor, nabilone, nafoxidine, neocarzinostatin, octreotide acetate, ormaplatin, oxaliplatin, paclitaxel, pala, piperazinedione, pipobroman, pirarubicin, piritrexim, piroxantrone hydrochloride, PIXY-321, porfimer sodium, prednimustine, procarbazine, progestins, pyrazofurin, razoxane, sargramostim, semustine, spirogermanium, spiromustine, streptonigrin, sulofenur, suramin sodium, tamoxifen, taxotere, tegafur, teniposide, terephthalamidine, teroxirone, thiotepa, thymidine injection, tiazofurin, toremifene, trifluoperazine hydrochloride, trifluridine, trimetrexate, tumor necrosis factor, uracil mustard, vinzolidine, Yoshi 864, zorubicin, TNF binding proteins, mycophenolate, fingolimod, myrocin, Everolimus, Gusperimus, Pimecrolimus, Sirolimus, Zotarolimus, Tacrolimus, Temsirolimus, Abatacept, Alefacept, Belatacept, TNF inhibitor, Etanercept, Anakinra, Azathioprine, Ciclosporin, Leflunomide, Methotrexate, Mycophenolic acid, Thalidomide, acivicin, aclarubicin, acodazole, acronycine, adozelesin, alanosine, aldesleukin, allopurinol sodium, aminoglutethimide, amonafide, ampligen, androgens, anguidine, aphidicolin glycinate, asaley, 5-azacitidine, *Bacillus* calmette-guerin (BCG), Bakers Antifol (soluble). steroidal drugs, glucocorticoids, cortisone, cortisol, alclometasone, amcinonide, beclometasone, betamethasone, budesonide, ciclesonide, clobetasol, clobetasone, clocortolone, cloprednol, cortivazol, deflazacort, deoxycorticosterone, desonide, desoximetasone, dexamethasone, diflorasone, diflucortolone, difluprednate, fluclorolone, fludrocortisone, fludroxycortide, flumetasone, flunisolide, fluocinolone acetonide, fluocinonide, fluocortin, fluocortolone, fluorometholone, fluperolone, fluprednidene, fluticasone, formocortal, halcinonide, halometasone, hydrocortisone aceponate, hydrocortisone buteprate, hydrocortisone butyrate, loteprednol, medrysone, meprednisone, methylprednisolone, methylprednisolone aceponate, mometasone furoate, paramethasone, prednicarbate, prednisone, prednisolone, prednylidene, rimexolone, tixocortol, triamcinolone, ulobetasol and all derivatives of said glucocorticoids; Non-steroidal anti-inflammatory drugs, cyclooxygenase inhibitors, Salicylates, Acetylsalicylic acid, Amoxiprin, Benorilate, Choline magnesium salicylate, Diflunisal, Faislamine, Methyl salicylate, magnesium salicylate, salicyl salicylate, Arylalkanoic acids, Diclofenac, Aceclofenac, Acemetacin, Bromfenac, Etodolac, Indometacin, nabumetone, sulindac, tolmetin, Arylpropionic acids, Fenbufen, Fenoprofen, Flurbiprofen, Ketoprofen, Ketorolac, Loxoprofen, ibuprofen, carprofen, naproxen, oxaprozin, tiaprofenic acid, suprofen, N-Arylanthranilic acids, Mefenamic acid, Meclofenamic acid, Pyrazolidine derivatives, Phenylbutazone, Azapropazone, Metamizole, Oxyphenbutazone, Sulfinpyrazone, Oxicams, Piroxicam, Lornoxicam, Meloxicam, Tenoxicam, COX-2 Inhibitors, Celecoxib, NS-398, RS-57067, Etoricoxib, flosulid, APHS, Lumiracoxib, meloxicam, SC-57666, Parecoxib, S-2474, Rofecoxib, etodolac, JTE-522, DuP-697, Valdecoxib, celecoxib, SC-58125, Sulphonanilides, L-745337, L-748780, L-761066, Nimesulide, valdecoxib, COX-inhibiting nitric oxide donators, Fluproquazone, Licofelone, Omega-3 fatty acids, herb extracts, extracts of hyssop, ginger, Turmeric, Arnica montana, sesquiterpene lactone and willow bark, Helenalin, capsaicin, thrombolytics, anticoagulants, antiplatelet drugs, Vitamin K antagonists, Acenocoumarol, Clorindione, Coumatetralyl, Dicumarol, Diphenadione, Ethyl biscoumacetate, Phenprocoumon, Phenindione, Tioclomarol, Warfarin, heparins, Antithrombin III, Danaparoid, Heparin, Sulodexide, low molecular weight heparins, Bemiparin, Dalteparin, Enoxaparin, Nadroparin, Parnaparin, Reviparin, Tinzaparin, glycoprotein IIb/IIIa inhibitors, Abciximab, Eptifibatide, Tirofiban, ADP receptor inhibitors, Clopidogrel, Ticlopidine, Prasugrel, prostaglandin analogues, Beraprost, Prostacyclin, Iloprost, Treprostinil, Enzymes, plasminogen activators, Alteplase/Reteplase/Tenecteplase, Streptokinase, Urokinase/Saruplase, Anistreplase, serine endopeptidases, Ancrod, Drotrecogin alfa/Protein C, Fibrinolysin, Brinase, Direct thrombin inhibitors, Argatroban, bivalirudin, Dabigatran, Desirudin, Hirudin, Lepirudin, Melagatran, Ximelagatran, Acetylsalicylic acid, Aloxiprin, Ditazole, Carbasalate calcium, Cloricromen, Dipyridamole, Indobufen, Picotamide, Triflusal, Apixaban, Defibrotide, Dermatan sulfate, Fondaparinux, Rivaroxaban, Tissue plasminogen activator, statins, Atorvastatin, Cerivastatin, Fluvastatin, Lovastatin, Mevastatin, Pitavastatin, Pravastatin, Rosuvastatin, Simvastatin, fibrates, Clofibrate, Bezafibrate, Aluminium clofibrate, Gemfibrozil, Fenofibrate, Simfibrate, Ronifibrate, Ciprofibrate, Etofibrate, Clofibride, niacin, niacin derivatives, Niceritrol, Nicofuranose, Aluminium nicotinate, Nicotinyl alcohol, Acipimox, bile acid sequesterants, Colestyramine, Colestipol, Colextran, Colesevelam, ezetimibe, phytosterols, cholestatin, campesterol, stigmasterol, brassicasterol, β-sitosterol, ergosterol, CETP Inhibitors, squalene synthase inhibitor, ApoA-1 Milano, AGI-1067, Dextrothyroxine, Probucol, Tiadenol, Benfluorex, Meglutol, Omega-3-triglycerides, Magnesium pyridoxal 5-phosphate glutamate, Policosanol, Ezetimibe, agents which engineer the Antisense knockdown of the protooncogene c-myc, Morpholino oligonucleotides, immunosuppressant and anticancer drugs: sirolimus/rapamycin, tacrolimus, everolimus, zotarolimus, paclitaxel, docetaxel, paclitaxel derivatives, tranilast and the like, enzymes, enzymes involved in metabolism, catabolism, DNA replication, DNA repair, RNA synthesis, post-translational modification of other proteins; structural proteins, F-actin, α-tubulin and β-tubulin, Class III β-tubulin, γ-tubulin, δ and ϵ tubulin, microtubules of tubulin, collagen, elastin, cartilage, keratin, motor proteins, bone morphogenic protein, proteins involved in osteogenesis, heparin, myosin, kinesin, dynein; proteins involved in cell signalling and signal transduction; proteins involved in ligand transportation, membrane proteins; transmembrane proteins; ion channel proteins; antibodies; human Ribo Nucleic Acids; and human Deoxyribo Nucleic Acids among others.

In a further application, the current coating method may be used to adhere a biocidal or bacteriostatic coating to surfaces generally at risk of being colonized by bacteria. In particular the surfaces of medical equipment, surgical instruments and surfaces generally exposed in the health care environment may be rendered biocidal. Suitable active agents that may be used in conjunction with carrier matrices for such applications include antimicrobial polymers, N-halamines, nitrogen containing polymers, quaternary ions and colloidal metals. Examples include: poly(4-acrylamido-N-(5-methyl-3-isoxazolyl)benzenesulfonamide), poly(4-methacrylamido-N-(5-methyl-3-isoxazolyl)-benzenesulfonamide), poly(N-[4-sulfamido-N-(5-methyl-3-isoxazolyl)phenyl]-maleimide, poly(N-tri-n-butyltin maleimide-co-styrene-co-m-acryloylamino-(tri-n-butyltinbenzoate), poly(2-hydroxy-3-(5-methyl-1,3,4-thiadiazol-2-yl)thiopropyl methacrylate), poly(1-ethyl-6-fluoro-7-{4-[2-hydroxy-3-)2-methylacryloyloxy)propyl]piperazin-1-yl}-4-oxo-1,4-dihydroquinolin-3-carboxylic acid), poly(2,4,4'-trichloro-2'-acryloyloxydiphenyl ether), poly(2,4,4'-trichloro-2'-acryloyloxydiphenyl ether-co-methylmethacrylate), poly(2,4,4'-trichloro-2'-acryloyloxydiphenyl ether-co-styrene), poly(2,4,4'-trichloro-2'-acryloyloxydiphenyl ether-co-acrylic acid), poly(allyl p-hydroxyphenyl acetate), poly(p-hydroxyphenyl acetate), poly(p-2-propenoxyphenol), poly(p-phenylcarboxy acetate), poly(3-acryloxypropyl o-carboxybenzoate), poly(3-methacryloxy p-hydroxyphenyl acetate), N-cyclic halamines, chlorine bleached polymers, chlorine bleached poly(1-acryloyl-2,2,5,5-tetramethylimidazolidin-4-one-co-acrylonitrile), chlorine bleached poly(1-acryloyl-2,2,5,5-tetramethylimidazolidin-4-one-co-methylmethacrylate), chlorine bleached poly(1-acryloyl-2,2,5,5-tetramethylimidazolidin-4-one-co-vinyl alcohol), poly(5-chloro-8-quinolinyl acrylate), poly(acylic acid-co-5-chloro-8-quinolinyl acrylate), poly(acrylamide-co-5-chloro-8-quinolinyl acrylate), poly(N-vinyl-2-pyrrolidone-co-5-chloro-8-quinolinyl acrylate), poly(p-vinylbenzyltetramethylenesufonium tetrafluoroborate), poly(p-ethylbenzyl tetramethylenesulfonium tetrafluoroborate), poly (methacryloyloxydodecyl pyrimidinium bromide), poly(methacryloyloxydodecyl pyrimidinium bromide-co-acrylic acid), poly(quaternary amine methacrylate-co-2-hydroxyethyl methacrylate), poly(trialkyl-3-vinylbenzyl]phosphonium chloride), poly(trialkyl-4-vinylbenzyl] phosphonium chloride), poly(2,4-dichlorophenyl acrylate), poly(2,4-dichlorophenyl acrylate-co-vinyl acetate), poly(3-triethoxysilylpropyl-5,5-dimethylhydantoin), poly(vinylbenzyl chloride-co-2-chloroethyl vinyl ether), poly(vinylbenzyl chloride-co-methylmethacrylate) quaternized with triphenylphosphine and triethylamine; RAAS-4G treated with p-hydroxybenzoic acid, 2,4-dihydroxybenzoic acid, and 3,4,5-trihydroxybenzoic acid; 2-benzimidazolecarbamoyl moiety coupled to poly(ethylene-co-vinyl alcohol); poly(styrene-co-maleic anhydride) coupled to ampicillin; poly(styrene-co-maleic anhydride) coupled to 4-aminophenol; poly (methacryloyloxyethyl trioctyl phosphonium chloride-co-N-isopropylacrylamide); sulfopropylbetaine copolymers; poly [4-(2-tributylphosphonioethyl) styrene chloride-co-4-(2-chloroethyl)-styrene]; poly[4-(3-tributylphosphoniopropyl)-styrene chloride-co-4-(3-chloropropyl)styrene]; glycidyl methacrylate-1,4-divinylbenzene copolymer treated with hydrogen chloride and then triethylamine or N,N-dimethyloctylamine or N,N-dimethyldodecylamine or N,N-dimethylhexadecylamine; glycidyl methacrylate-1,4-divinylbenzene copolymer treated with hydrogen chloride and then triethylphosphine or tributylphosphine or trioctylphosphine; phosphonium salts of styrene-7% divinylbenzene copolymer; the phosphonium and ammonium salts of glycidyl methacrylate polymers; poly(glycidyl methacrylate-co-2-hydroxyethyl methacrylate) quaternized with triethylamine, triphenylphosphine, and tributylphosphine; quaternary ammonium-functionalized poly(propylene imine); quaternary phosphonium-functionalized poly(propylene imine); poly(ethylene glycol-N-hydantoin); poly(ethylene glycol-N-imidazolidin-4-one); polystyrene hydantoins; polystyrene triazinedione; poly[1,3,5-trichloro-6-methyl-6-(4'vinylphenyl)-1,3,5-triazine-2,4-dione]; chloromethylated polystyrene beads coupled with the potassium salt of 5,5-dimethylhydantoin; chloromethylated polystyrene beads coupled with dimethyldodecylamine; chloromethylated polystyrene beads coupled with N,N,N',N'-tetramethylethylenediamine; N-halogenated poly(styrenehydantoins); poly[3-(5,5-dimethylhydantoinylpropyl) siloxane-co-3-dimethyldodecylammoniumpropylsiloxane chloride]; poly[3-(5,5-dimethylhydantoinylpropyl)hydroxysiloxane]; chitosan-alginate hydrogels; poly(2-chloroethylvinyl ether-co-vinylbenzyl chloride) quaternized with triethylamine or triphenylphosphine or tributylphosphine; Quaternized poly (vinylpyridine), co-polymers of Polyethyleneglycol methyl ether methacrylate (PEGMA) and hydroxyethyl methacrylate (HEMA) and Quaternized poly(vinylpyridine), quaternized N-alkyl chitosan; N-alkyl chitosan quaternized with methyl iodide; chitosan-grafted poly(ethylene terephthalate); quaternized chitosan-grafted poly(ethylene terephthalate); chitosan-g-mono (2-methacryloyloxyethyl) acid phosphate; chitosan-g-vinylsulfonic acid sodium salt; N-(2-Hydroxy) propyl-3-trimethylammonium chitosan chloride; dipyridyl dextran conjugates; N-benzyldipyridyl dextran conjugates; N-n-octyldipyridyl dextran conjugates; Loofah fibre grafted Methacryloyloxyethyl trimethyl ammonium chloride, Loofah fibre grafted tributyl-4-vinylbenzyl phosphonium chloride; Loofah fibre grafted 2,3-epithiopropyl methacrylate; Loofah fibre grafted 2,3-epithiopropyl methacrylate quaternized with triethylenetetramine; Loofah fibre grafted 2,3-epithiopropyl methacrylate quaternized with triethylenetetramine complexed with silver ions, N-methyl arylmorpholinoacid (AMPA), N,N-dimethyl AMPA, poly-(ethylene oxamide-N,N'-diacetate), complexes of poly-(ethylene oxamide-N,N'-diacetate) with metal ions, poly(4-[(4-hydroxybenzylidene) amino]phenol), polymers and co-polymers synthesized from the monomers 2,4-dichloro phenyl acrylate and 8-quinolinyl methacrylate, Copolymers of 2-acrylamido-2-methyl-1-propanesulfonic acid/maleic acid, Quaternary ammonium salts (QAS) modified polysiloxane, Poly(crotonic acid-co-2-acrylamido-2-methyl-1-propanesulfonic acid)-metal complexes with copper(II), cobalt (II), and nickel(11), mandelic acid condensation polymers, SAMMA, N-((4-amino sulfonyl)phenyl)acrylamide (APA), co-polymers of N-((4-amino sulfonyl)phenyl)acrylamide (APA) and 2-hydroxyethyl acrylate (HEA) and acrylic acid (AA), poly(2-(dimethylamino)ethyl methacrylate) with alkyl bromide modified tertiary amine groups, Poly[(mu(3)-N-acetyl-L-histidinato-kappa N-4,O:O:O')silver(I)], polyphenols, poly[(2-hydroxy-4-methoxybenzophenone) propylene] resin, N-quaternized chitosan and chitooligomer, acyated chitosans, silver(I) sulfanylcarboxylates and Quaternized polyethyleneimine, colloidal tin, nickel or silver among others.

Where the antimicrobial activity of the coating arises from polymers having n-halamine or their hydrogenated precursors attached thereto the liquid phase may additionally be augmented with halogen compounds such as for example methylenechloride, hypochlorite bleach and other such sources of halogen.

One may appreciate the advantage of acquiring commonly available plastics in powder form and being able to utilise these as is to form coatings by the processes of the present application. One may also appreciate the advantage of being able to augment polymers commonly available in powder form with biocidal functional group using the known complex and hazardous synthesis routes disclosed in the prior art in a controlled or closed environment and subsequently being able to form the so derivatised particles into a coating by the present invention in environments that are not conducive to the use of hazardous chemical processes such as surfaces in hospitals, industrial, domestic and food processing environments.

In one application the surface of interest may be of a building material such as for example the plaster, grout or concrete on walls and the machinery used to apply the process is mobile such as suitably modified mobile sand blasters and the like and the process may be applied to existing surfaces in constructed buildings.

In other biocidal coating applications the surface is of metal such as a surgical instrument the panels, handles, and other regularly contacted surfaces at or on doors, access and egress points, sinks, wash basins, dryers, work stations and the like.

The present application offers a number of advantages over prior methods employed to modify surfaces with active agents and coatings:

1. Although heat is generated at the surface this heat is highly localized and dissipates rapidly aided by the liquid phase of the aerosol allowing active agents incorporated to survive the process intact.
2. Active agents are dispersed evenly within the coating incorporated in conjunction with the carrier matrix in a single step process in a controlled and tailored manner.
3. The process allows a sufficient density of antecedent material at the surface to form a continuous coating of greater than nanometer dimension circumventing the concentration limitations of previous disclosures.
4. The process circumvents the use of complex chemical additives such as cross-linking agents, stabilizers, initiators, silane or epoxy coupling agents and the curing treatments associated with other coating processes that facilitate the reaction of coating compositions inherently and with the surface of a substrate. All such factors capable of affecting the chemistry and desired functionality within a coating including antimicrobial or therapeutic functionality.
5. The process provides for the adherence of a wide range of materials including those that would not ordinarily form an adhered coating by ordinary spraying or painting applications: i.e. polymers and ceramics that do not have the chemical functionality to react inherently with each other or a substrate if simply painted or sprayed onto a surface at ordinary temperatures.

The adhered coating at the surface of substrates may be subsequently altered by further treatments so as to augment the chemical and physical nature of the adhered coating towards specific function. Such treatments include modified shot peening or grit blasting treatments, blasting treatments, etching treatments, precipitation treatments, dissolution treatments or cleaning treatments.

For example hydroxyapatite is currently deposited at implant surfaces by high temperature processes such as plasma spray and thermal sputtering. In such processes, hydroxyapatite particles are partially melted en route to a surface utilizing temperatures in excess of 1200° C. These particles solidify to form a coating on the surface. Such processes result in the partial degradation of the Hydroxyapatite to other calcium phosphates primarily as a result of hydroxyl (structural water) loss. The present application may be advantageously used to coat hydroxyapatite onto a surface without water loss particularly where the liquid phase used in the aerosol is comprised at least in part of water. Active agents may subsequently be absorbed into such hydroxyapatite layers.

In other instances components contained in the coating may be advantageously dissolved out of the coating to tailor its morphology. For example if the antecedent composition and ultimately the coating contain sodium bicarbonate such components may be readily dissolved out of the surface on exposure to mildly acidic or aqueous solution so as to engineer the porosity of the coating for subsequent use.

One treatment that may be particularly advantageous where the coating is polymeric is a subsequent bombarding treatment. For example soft plastics not readily adhered to surfaces by current methodologies at ordinary temperatures such as PTFE, low density polyethylene and the like may be readily coated onto a surface by the present process to a desired thickness. Exposure of such surfaces to particulate propelled at the surface may result in the particulate being embedded in the polymer coating. Colloidal metal and other potential active agents may be advantageously embedded in such coatings using grit blasting or shot peening equipment to further augment the coating properties, in the particular case of silver to render it bacteriostatic. Other such polymer coatings may be similarly augmented.

The present application is particularly suitable for coating the surfaces of medical implants with a carrier matrix (such as by way of example biodegradable polymers, biocompatible ceramics or combinations thereof). Therapeutic agents (such as by way of example antirestenosis, antithrombosis and antimicrobial drugs) may be incorporated into this coating.

Examples of suitable implants for this technique would include hard-tissue implants, dental and orthopedic, stents, pacemakers, defibrillators, guide wires and catheters. In this arrangement, the implant would be shot peened or grit blasted using commercially available shot or abrasive grit while an atomised suspension of carrier matrix is delivered to the surface. The abrasive or shot and aerosol may for example be delivered to the implant surface through a coaxial venturi arrangement or the multiple nozzle arrangement, an example of the co-axial form is shown in FIG. 1 (designed rig with carrier matrix/solvent on the outside) a standard grit-blasting machine is used to fluidise the shot or grit in the inner venturi. Suitably, the shot or grit has a particle size in the range of 1 micron to 1000 microns. The carrier matrix is suspended in a suitable solvent. The fluid jet is air. The fluid jet impinges the surface at an angle of at least 5 degrees to the implant surface. Suitably, the venturi is held within 500 mm of the implant surface.

A therapeutic agent may subsequently be adsorbed onto the carrier matrix in a subsequent treatment or may alternatively be included as a component in the antecedent composition.

In yet another arrangement, the sol of carrier matrix precursors is by way of example a calcium phosphate gel. Such ceramic sols are normally converted into their crystalline counterparts by prolonged exposure to heat (sintering), undesirable particularly where the desired calcium phosphate is Hydroxyapatite. The current process does not involve prolonged exposure to high temperature to facilitate such sol-gel reactions. As a result active agents may be incorporated in the gel and simultaneously deposited at the surface with the further advantage that the agent is homogenously distributed in the coating.

Where the implant is a stent, the present method may be adapted to deliver a material for absorbing the energy generated by MRI scanning with the abrasive or shot and aerosol. The material for absorbing the energy generated by MRI scanning is suitably suspended in the aerosol liquid.

The efficacy of the methods of the present application will now be demonstrated by reference to some examples.

EXAMPLE 1

Figure 3:
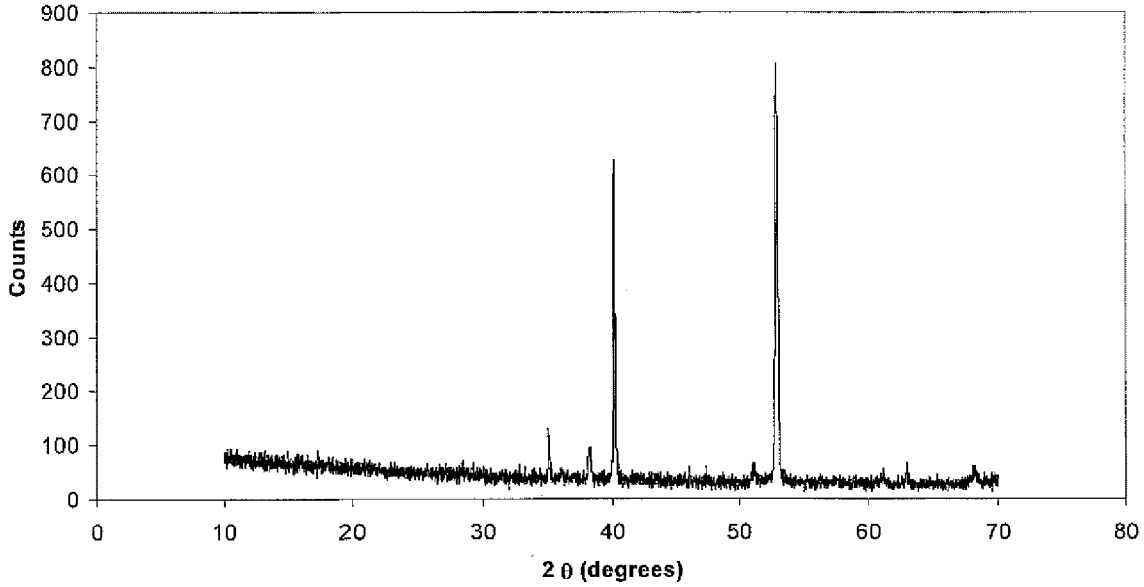
FIG. 3 is an X-ray Diffraction (XRD) pattern of an untreated titanium coupon per the prior art.
Figure 4:
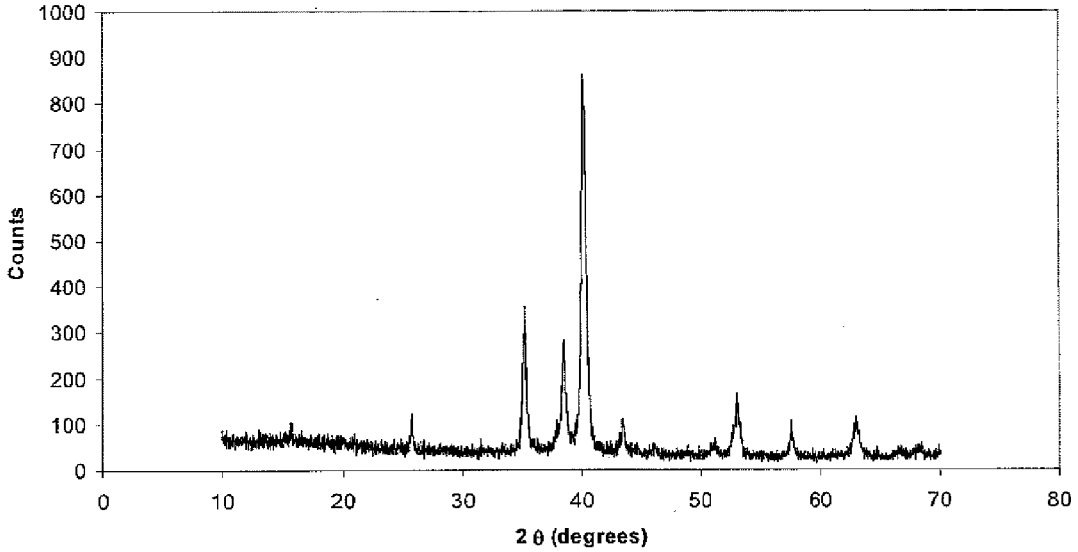
FIG. 4 is a XRD pattern of a titanium coupon subjected to nitriding as per a method described below (Example 1).

A 1 cm×1 cm commercially pure titanium coupon was grit blasted with alumina grit, with an average particle diameter of 100 microns, using a Vaniman grit blaster. The nozzle was held 20 mm from the surface and the nozzle was held perpendicular to the surface. Nitrogen gas substantially free of oxygen at a pressure of 7 bar was used as the carrier fluid. The silicon carbide nozzle had an orifice diameter of 1 mm. Four passes were made of the surface. A comparison of the XRD patterns of a titanium coupon (FIG. 3) and a titanium coupon treated as above (FIG. 4) reveals a peak at 43.5 2 in the treated coupon characteristic of titanium nitride and not seen in titanium or titanium oxide.

The coupon was further grit blasted with alumina using a Vaniman grit blaster. An atomised dispersion of Polytetrafluoroethylene (PTFE) nano-particles in ethanol was directed at the same point on the surface during the blasting process. The alumina had an average particle diameter of 100 microns and the PTFE particles had an average particle diameter of 200 nm. The alumina was delivered through a silicon carbide nozzle with an orifice diameter of 1 mm while the aerosol was delivered from the paint sprayer attachment of a standard compressor. Nitrogen gas substantially free of oxygen at a pressure of 5 bar was used as the carrier fluid for the alumina. The titanium coupon was held within 60 mm of the nozzles. Four passes were made of the surface.

Figure 5:
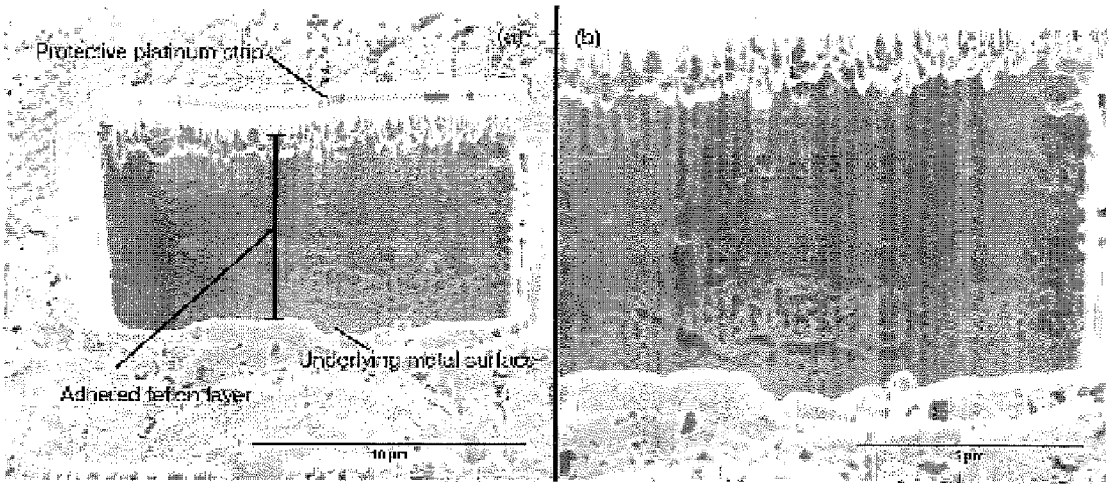
FIG. 5 is a Focused ion beam (FIB) image of an adhered layer of PTFE material deposited as per the method of Example 1.

The coupon was then subjected to ultrasonic cleaning for 20 minutes. The surface was then dried under a stream of air. FIG. 5 is a Focussed Ion Beam (FIB) image of a milled section of the adhered Teflon layer obtained after all treatments were completed. The layer is at least 5 microns in depth and is clearly distinct from the coupon itself. Furthermore the adhered Teflon layer has nanoporosity.

EXAMPLE 2

A 1 cm×1 cm commercially pure titanium coupon was subjected to bombardment with alumina grit and an atomised dispersion of PTFE powder in ethanol. The alumina had an average particle diameter of 100 microns and the PTFE particles had an average particle diameter of 200 nm. The alumina grit was delivered to the surface using a Vaniman grit blaster through a silicon carbide nozzle with an orifice diameter of 1 mm. The carrier gas was air at a pressure of 5 bar. The aerosol of PTFE in ethanol was generated using an airbrush. An air stream at 5 bar pressure was delivered through a venturi over a second venturi linked to a reservoir of the PTFE nanoparticles in ethanol generating the aerosol via the Bernouli effect. The air stream carrying the alumina grit and the air stream carrying the aerosol were focused on the titanium coupon. The titanium coupon was held within 60 mm of the nozzles. The titanium coupon was placed at this point. Four passes were made of the surface.

Figure 6:
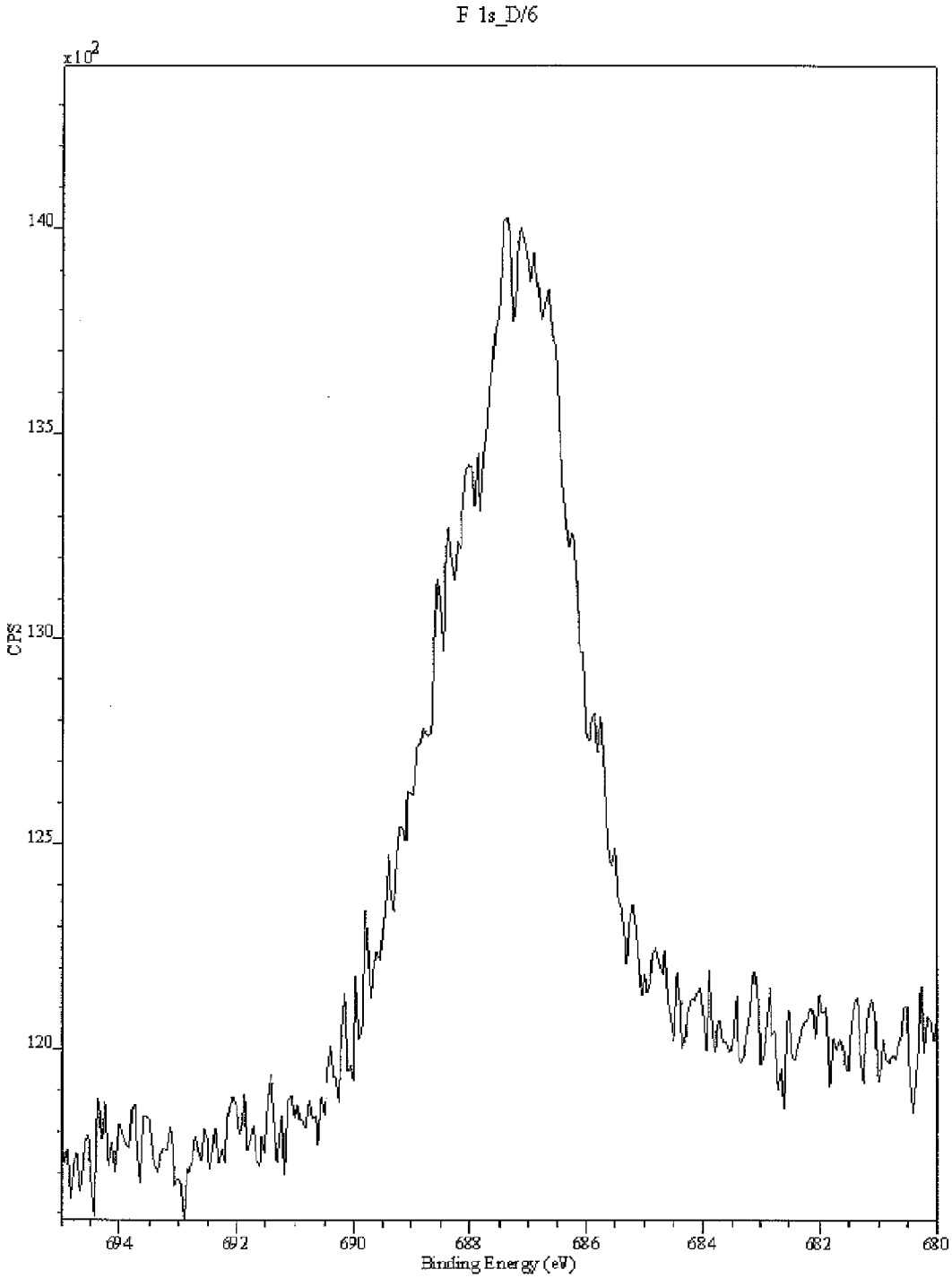
FIG. 6 is a narrow scan X-ray photoelectron spectrum of the fluorine region of a layer of PTFE material adhered by a further exemplary method (Example 2 below).

The coupon was then subjected to ultrasonic cleaning for 20 minutes. The surface was then dried under a stream of air. FIG. 6 is a narrow scan X-ray Photoelectron spectrum of the fluorine region of binding energy obtained after all treatments were completed. It clearly shows the presence of fluorine on the coupon surface indicating the presence of PTFE.

EXAMPLE 3

A 1 cm×1 cm commercially pure titanium coupon was subjected to bombardment with alumina grit and an atomised dispersion of nano-crystalline hydroxyapatite in ethanol. The alumina had an average particle diameter of 100 microns. The alumina grit was delivered to the surface using a Vaniman grit blaster through a silicon carbide nozzle with an orifice diameter of 1 mm. The carrier gas was air at a pressure of 5 bar. The atomised dispersion of hydroxyapatite in ethanol was generated using an airbrush. An air stream at 5 bar pressure was delivered through a venturi over a second venturi linked to a reservoir of the hydroxyapatite in ethanol generating the aerosol via the Bernouli effect. The air stream carrying the alumina grit and the air stream carrying the aerosol were focussed on the titanium coupon. The titanium coupon was held within 60 mm of the nozzles. Four passes were made of the surface.

Figure 7:
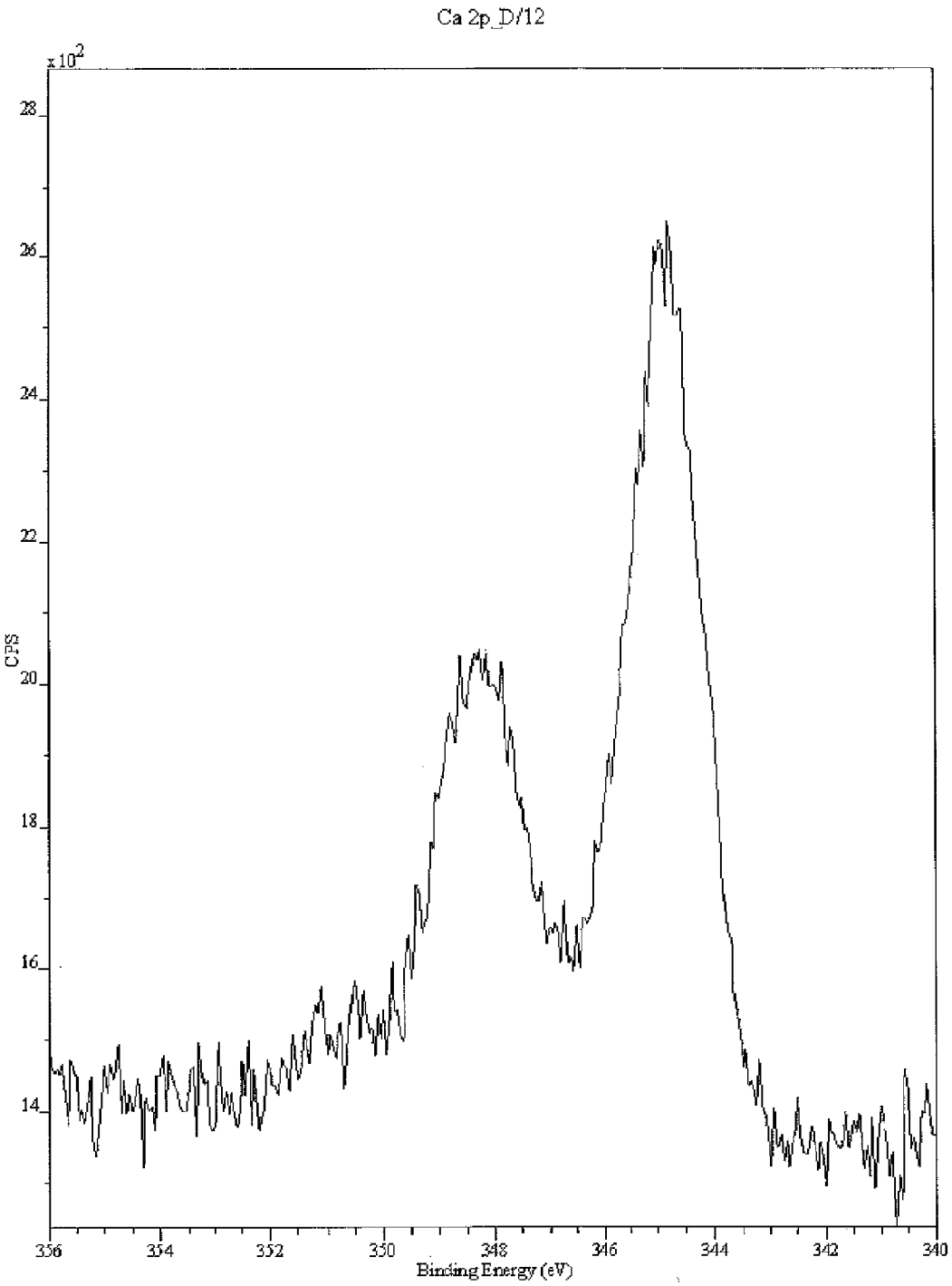
FIG. 7 is a narrow scan X-ray Photoelectron spectrum of the calcium region of a layer of hydroxyapatite adhered by a further exemplary method (Example 3 below).

The coupon was then subjected to ultrasonic cleaning for 20 minutes. The surface was then dried under a stream of air. FIG. 7 is a narrow scan X-ray Photoelectron spectrum of the calcium region of binding energy obtained after all treatments were completed. It clearly shows the presence of calcium on the coupon surface indicating the presence of hydroxyapatite.

EXAMPLE 4

A 1 cm×1 cm commercially pure titanium coupon was subjected to bombardment with alumina grit and an atomised dispersion of nano-crystalline hydroxyapatite in de-ionised water. The alumina had an average particle diameter of 100 microns. The alumina grit was delivered to the surface using a Vaniman grit blaster through a silicon carbide nozzle with an orifice diameter of 1 mm. The carrier gas was air at a pressure of 5 bar. The atomised dispersion of hydroxyapatite in water was generated using a paint sprayer. The dispersed hydroxyapatite in water was drawn from a reservoir via the Bernouli effect using an air stream with a pressure of 5 bar. The dispersion was ejected from a nozzle and air streams either side of the jet generated an aerosol. The air stream carrying the alumina grit and the air stream carrying the aerosol were focussed on the titanium coupon. The titanium coupon was held within 60 mm of the nozzles. Four passes were made of the surface.

Figure 8:
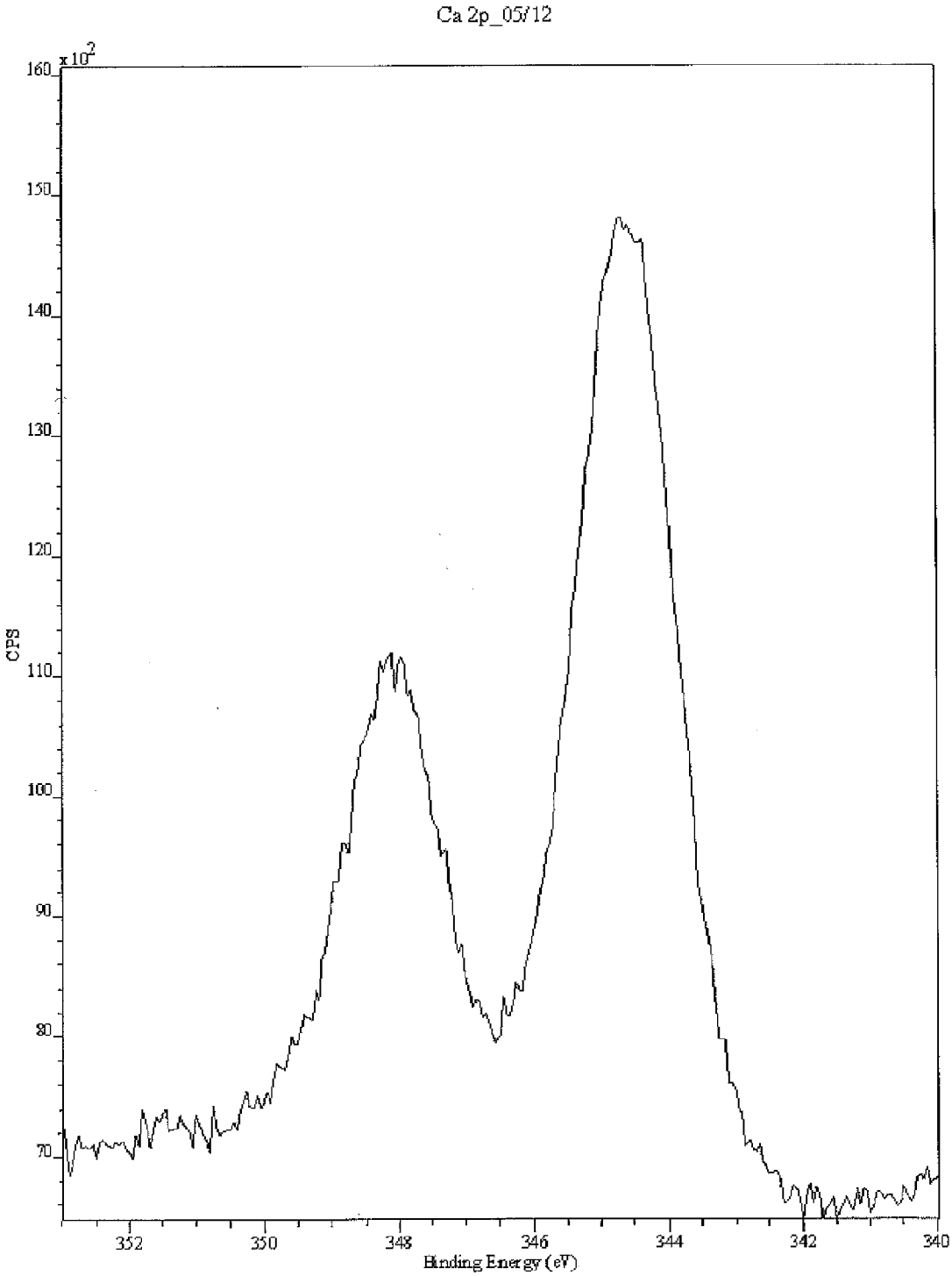
FIG. 8 is a narrow scan X-ray Photoelectron spectrum of the calcium region of a layer of hydroxyapatite adhered by a further exemplary method (Example 4 below).
Figure 9:
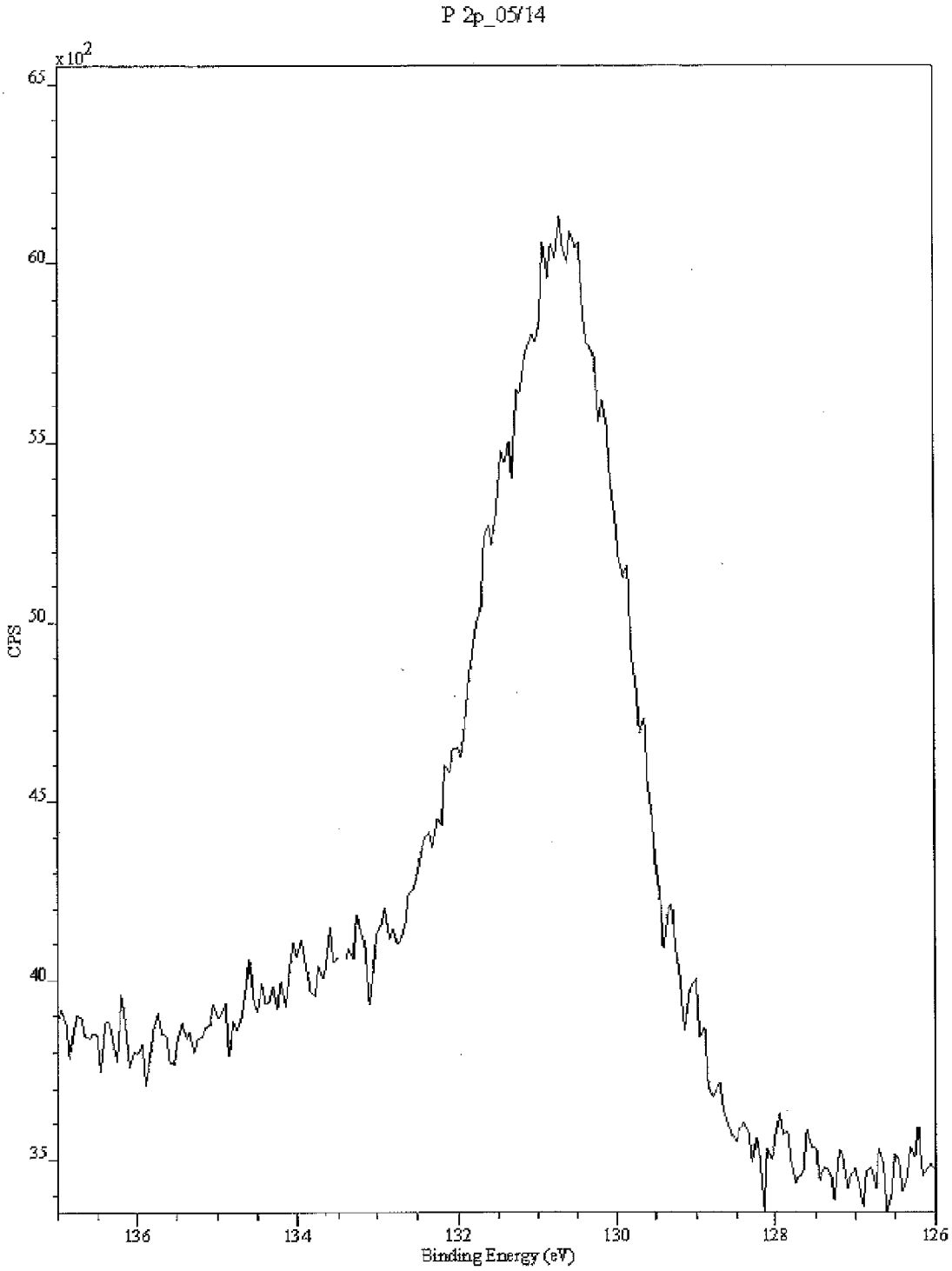
FIG. 9 is a narrow scan X-ray Photoelectron spectrum of the phosphorous region of a layer of hydroxyapatite adhered by the method of Example 4.

The coupon was then subjected to ultrasonic cleaning for 20 minutes. The surface was then dried under a stream of air. FIGS. 8 and 9 are narrow scan X-ray Photoelectron spectra of the calcium and phosphorous regions of binding energies obtained after all treatments were completed. It clearly shows the presence of calcium on the coupon surface indicating the presence of hydroxyapatite.

EXAMPLE 5

Three 1 cm×1 cm commercially pure titanium coupons were subjected to bombardment with alumina grit and an atomised liquid consisting of 4 g nano-crystalline hydroxyapatite and 1 g of gentamicin in 100 ml of de-ionised water. The liquid was prepared 24 hours before the coupons were treated and was agitated constantly. The alumina had an average particle diameter of 100 microns. The alumina grit was delivered to the surface using a Vaniman grit blaster through a silicon carbide nozzle with an orifice diameter of 1 mm. The carrier gas was air at a pressure of 5 bar. The liquid colloid was atomised using a paint sprayer. The liquid was drawn from a reservoir via the Bernouli effect using an air stream with a pressure of 5 bar. The liquid was ejected from a nozzle and air streams either side of the jet atomised generated an aerosol. The air stream carrying the alumina grit and the air stream carrying the aerosol were focussed on the titanium coupons. The titanium coupons were held within 60 mm of the nozzles. Four passes were made of the surface of each coupon. The coupons were sonicated in de-ionised water for 5 minutes each.

Figure 10:
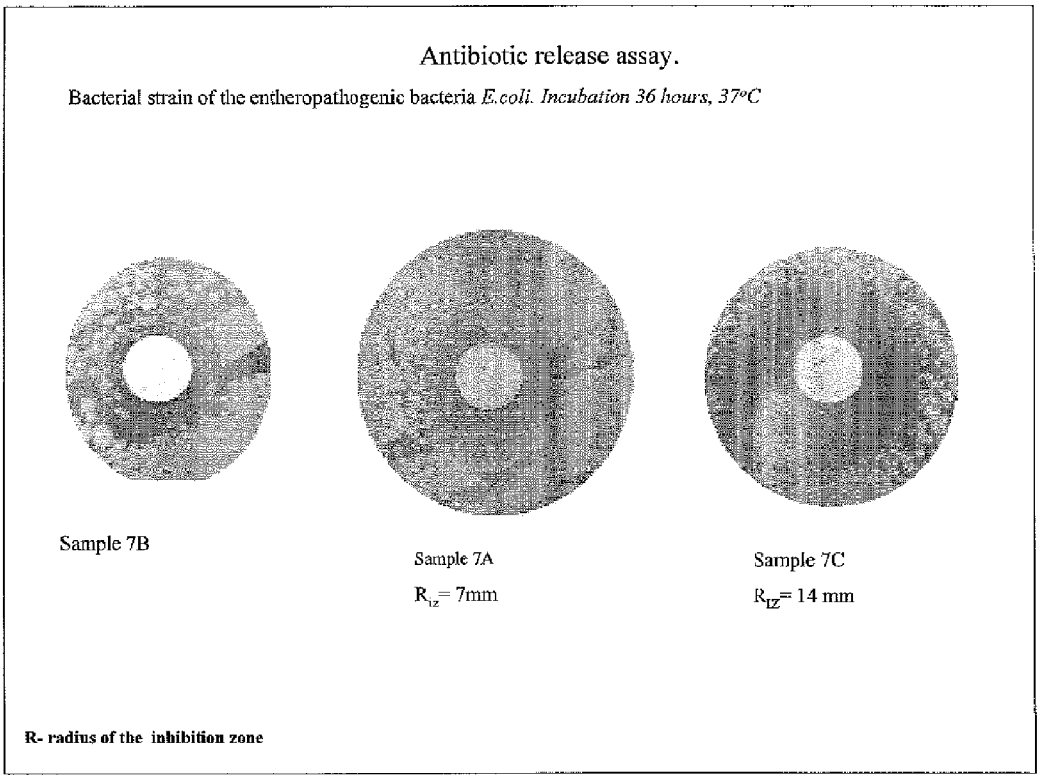
FIG. 10 are antibiotic Release assays for the titanium coupons treated as per another exemplary method (Example 5).

The antibacterial activity of the coupons was evaluated against Escheirichia Coli using an agar disc diffusion method. The bacteria were grown from stock culture on brain heart infusion (BHI) agar at 37° C. for 16 hr and isolated colonies were used to seed fresh cultures in 10 ml luria broth. After a further 16 hr incubation at 37° C. with shaking these cultures were diluted with mueller hinton (MH) broth to give an optical density (OD) of 600 in 0.05. 350 μlt of this bacterial suspension was streaked on plates containing MH agar to a depth of 4 mm. The gentamicin treated coupons were placed on the agar and the plates were inverted and incubated at 37° C. for 24 hrs. The results are shown in FIG. 10. A clear inhibition zone is seen around the gentamicin coupons indicating that the gentamicin was incorporated into the surface and remained active through the treatment process.

EXAMPLE 6

A 1 cm×1 cm commercially pure titanium coupon was subjected to bombardment with alumina grit and an atomised dispersion of comprising 2 g of nanoparticulate PTFE and 0.2 g of nanoparticulate silver in 100 ml of ethanol. The alumina had an average particle diameter of 100 microns. The alumina grit was delivered to the surface using a Vaniman grit blaster through a silicon carbide nozzle with an orifice diameter of 1 mm. The carrier gas was air at a pressure of 5 bar. The atomised dispersion was generated using a paint sprayer. The dispersed nanoparticles in ethanol was drawn from a reservoir via the Bernouli effect using an air stream with a pressure of 5 bar. The dispersion was ejected from a nozzle and air streams either side of the jet generated an aerosol. The air stream carrying the alumina grit and the air stream carrying the aerosol were focused on the titanium coupon. The titanium coupon was held within 60 mm of the nozzles. Four passes were made of the surface.

Figure 11:
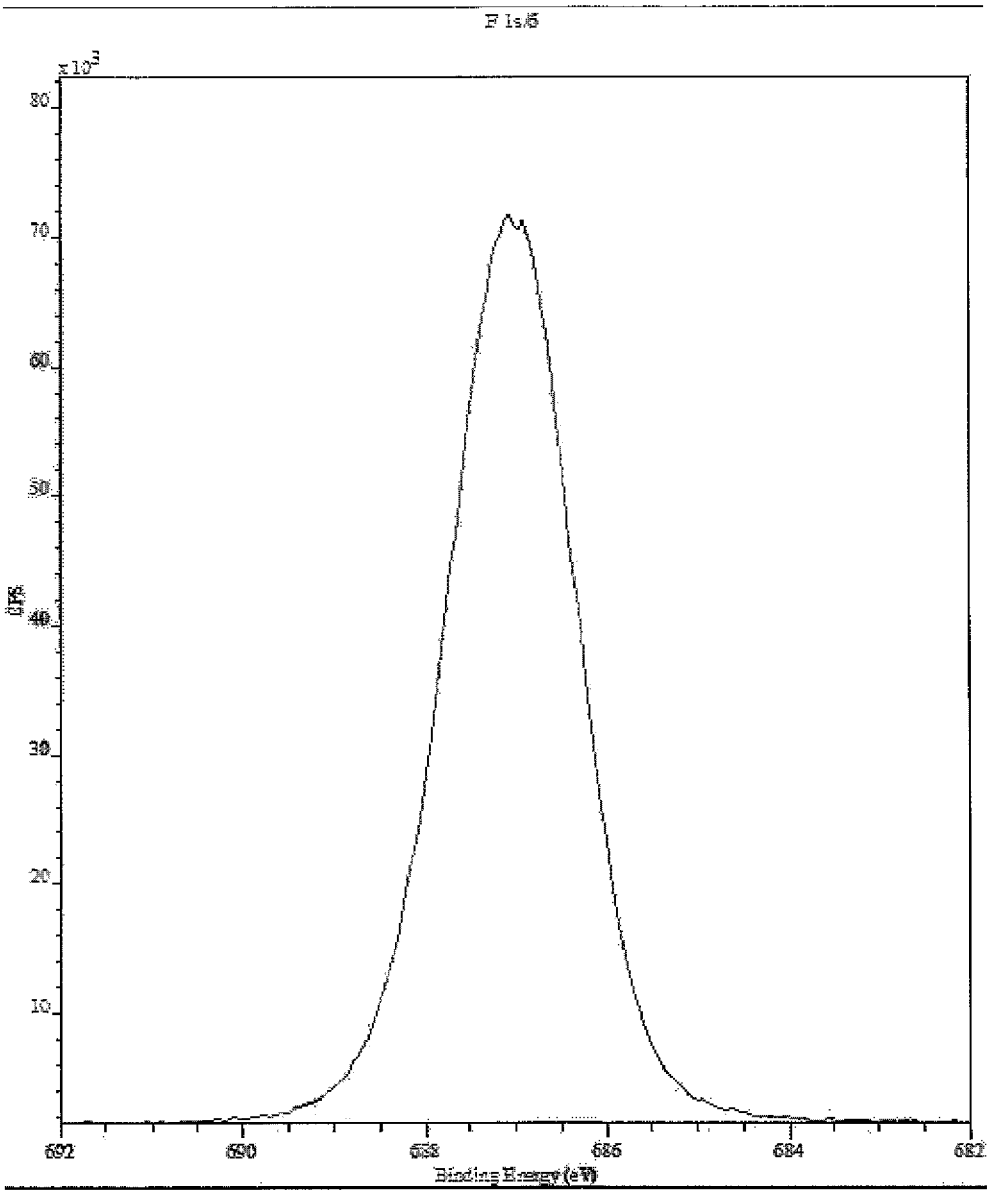
FIG. 11 is a narrow scan X-Ray Photoelectron spectrum of the F 1s region on a titanium coupon coated with a Teflon silver composition in accordance with an exemplary method.
Figure 12:
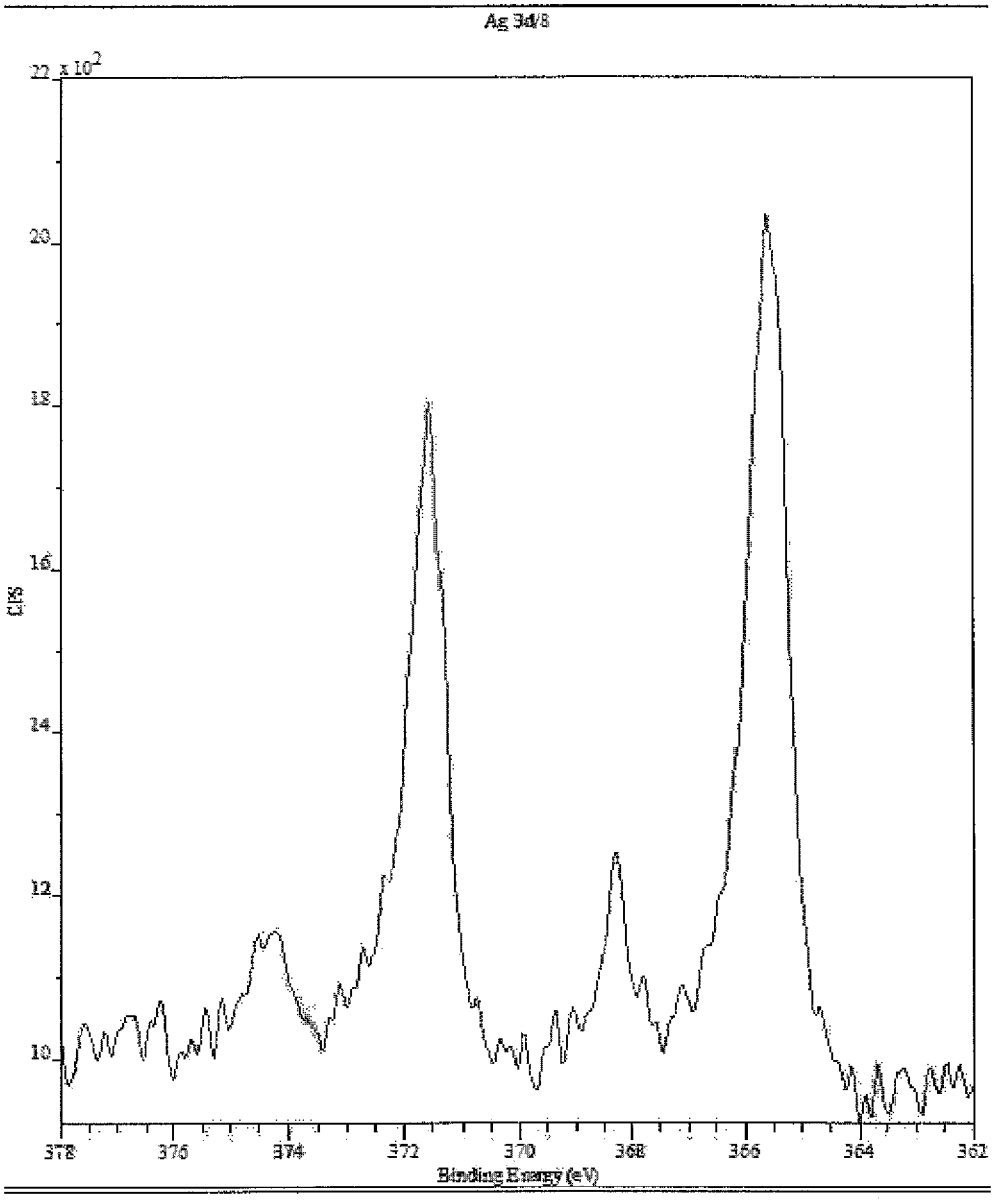
FIG. 12 is a narrow scan X-Ray Photoelectron spectrum of the Ag 3d region on a titanium coupon coated with a Teflon/silver composition in accordance with an exemplary method.

The coupon was then subjected to ultrasonic cleaning for 20 minutes. The surface was then dried under a stream of air. FIGS. 10 and 11 are narrow scan X-ray Photoelectron spectra of the fluorine Is and silver 3d regions respectively obtained after all treatments were completed. It clearly shows the presence of PTFE and the entrained silver on the coupon surface.

It will be appreciated that whilst certain examples of techniques have been provided that the invention may be varied in construction and design depending on the particular combinations of materials desired at a surface for a particular application. Accordingly, the invention is not limited to the embodiments described but may be varied in construction and detail but directed to the simultaneous delivery of a bombarding particulate and an aerosol to provide a surface coating where the coating is provided by the co-operation of the particulate and aerosol.

CITED REFERENCES

Arola, D. D. and McCain, M. L. (7 Jan. 2003) Method and apparatus for abrasive for abrasive fluid jet peening surface treatment, U.S. Pat. No. 6,502,442

Kuo, M. C. (15 Aug. 1995) Method of Corrosion Protecting of Steel Structural Components, U.S. Pat. No. 5,441,763

Muller, W.-D. and Berger, G. (8 Dec. 2004) Surface treated metallic implant and blasting material, United States of America Patent 2004/158330

Bru-Maginez, N., Kurdyk, B., Roques-Carmes, C., Breton, P. and Richard, J. (13 Aug. 2002) Method for mechanochemical treatment of a material, U.S. Pat. No. 6,431,958

Hisada, W. and Kihira, H. (27 Apr. 2004) Method for depositing metal having high corrosion resistance and low contact resistance against carbon onseparator for fuel cell, U.S. Pat. No. 6,726,953

Omori, S. and Kieffer, J. M. (18 Jan. 2000) Cold dry plating process for forming a polycrystalline structure film of zinc-iron by mechanical projection of a composite material, U.S. Pat. No. 6,015,586

Babecki, A. J. and Haehner, C. L. (28 Aug. 1973) Peen Plating, U.S. Pat. No. 3,754,976

Chu, H.-P. and Staugaitis, C. L. (12 Nov. 1985) Method of coating a substrate with a rapidly solidified metal, U.S. Pat. No. 4,552,784

Spears, R. L. (28 Jun. 1988) Apparatus and method of powder-metal peen coating metallic surfaces, U.S. Pat. No. 4,753,094

Seth, B. B. and Wagner, G. P. (24 Aug. 2004) Wear and erosion resistant alloys applied by cold spray technique, U.S. Pat. No. 6,780,458

Subramanian, R., Wagner, G. P. and Seth, B. B. (3 Sep. 2002) Thermal barrier coating applied with cold spray technique, U.S. Pat. No. 6,444,259

Kik, L. A. and Schuurnik, P. H. J. (14 May 1985) Process for applying a coating composition to a substrate and the coated substrate thus obtained, U.S. Pat. No. 4,517,248

Gruss, A. R. and Shapiro, T. A. (6 Jan. 1987) Method of abrasive cleaning and spray coating, U.S. Pat. No. 4,634,603

Stuiving a, M. E. S., Maas, A. M. and Carton, E. P. (11 Jun. 2002) Method for manufacturing a composite material, U.S. Pat. No. 6,403,210

Ganan-Calvo, A. (16 Jan. 2001) Device and Method for Creating Dry Particles, U.S. Pat. No. 6,174,469

Vose, P. V. (27 Apr. 2006) Compositions and methods relating to tribology, United States of America Patent Application 20060089270

Rie, K.-T., Stucky, T., Silva, R. A., Leitao, E., Bordji, K., Jouzeau, J.-Y. and Mainard, D. (1995) Surface and Coatings Technology Fourth International Conference on Plasma Surface Engineering Part 2, 74-75, 973-980

Chen, K. C. and Jaung, G. J. (1997) Thin Solid Films, 303, 226-231

Xue, L., Islam, M., Koul, A. K., Bibby, M. and Wallace, W. (1997) Advanced Performance Materials, 4, 389-408

Gil, F. J., Canedo, R., Padros, A. and Sada, E. (2002) Journal of Biomaterials Applications, 17, 31-43

Dong, H., Qi, P. Y., Li, X. Y. and Liewellyn, R. J. (2006) Materials Science and Engineering a-Structural Materials Properties Microstructure and Processing, 431, 137-145

Li, S. and Manory, R. R. (1995) Surface and Coatings Technology, 71, 108-111

Chen, F.-S. and Liu, L.-D. (2003) Materials Chemistry and Physics, 82, 801-807

The invention claimed is:

1. A method of forming a coating on a surface, the method comprising delivering an aerosol to the surface concomitant with bombarding the surface with particles in one or more gas streams so that antecedent materials of the coating provided within the gas stream(s) are transformed into the coating by the cooperative action of the particles impinging on the surface and presence of the aerosol, wherein the aerosol comprises at least in part the antecedent materials of the coating, wherein the aerosol is generated by atomizing a material comprising a liquid wherein the method does not utilize a high temperature plasma spray or thermal sputtering process, and wherein the material is one or more of the following:

a. a solution,
b. a suspension,
c. a gel,
d. a sol, and
e. a colloid.

2. The method of claim 1, wherein the particles comprise particles having attached an outer layer of material, wherein said outer layer of material comprises in part the antecedent materials of the coating.

3. The method of claim 1, wherein one or more of the following is employed to deliver the particles to the surface in a carrier gas stream: dry shot peening machine, dry blaster, wheel abrader, grit blaster, sand blaster and micro-blaster.

4. The method of claim 1, wherein the aerosol is produced by one or more of the following: Bernoulli atomizers, pressure atomisers, two-fluid atomisers, ultrasonic atomisers, modified spray dryers, modified spray coaters, airbrushes, electro spray atomisers, coaxial nozzle assemblies, and coaxial nozzle assemblies operating on the gas lens principle.

5. The method of claim 1, wherein the gas stream is substantially free of oxygen and comprises one or more of the following:

a. nitrogenous gases including ammonia and nitrogen,
b. inert gases including helium and argon,
c. carbonaceous gases including carbon monoxide, carbon dioxide and hydrocarbons,
d. sulfurous gases including sulfur monoxide, sulfur dioxide and sulfur trioxide,
e. halogen containing gases, and
f. hydrogen gas.

6. The method of claim 1, wherein the antecedent materials comprise one or more of the following: polymer, ceramic, glass, bio-glass, metal, metal alloy, active agent, monomer, ions, solvent and organo-metallic complexes.

7. The method of claim 1, wherein the antecedent material comprises an active agent chosen from one or more of the following:

a. a drug,
b. an antibiotic,
c. an anti-restenosis agent,
d. an anti inflammatory,
e. an anti-thrombotic,
f. a protein,
g. an oligo-peptide,
h. colloidal metal or organo-metallics,
i. an N-halamine, and
j. a quaternary ion.

8. The method of claim 1, wherein the particles and the aerosol are directed to the surface by a nozzle assembly, wherein movement of the nozzle assembly is automated to follow contours of a line, to follow contours of a surface, to rotate about at least one axis or combinations thereof.

9. The method of claim 1, wherein the method is performed in a chamber or cabinet substantially isolated from a surrounding environment and wherein the chamber or cabinet incorporates or is connected to one or more of the following:

a. filtration system,
b. pumping system,
c. waste reservoir,
d. sterilization equipment, and
e. heating system.

10. The method of claim 1, wherein a coated surface is subjected to a subsequent treatment to augment the properties of the coating, wherein the subsequent treatment is one or more of the following:

a. dissolution of material out of the coating to augment its morphology,
b. precipitation of material into or onto the coating,
c. particulate bombardment so as to embed particulate in the coating,
d. replenishment of components by ion exchange processes,
e. washing treatments to remove detritus matter and or replenish active agents,
f. polarisation treatments, and
g. electrical or magnetic polarization treatments.

11. The method of claim 1, wherein a coated surface is subjected to a subsequent treatment to augment properties of the coating wherein the coating is polymeric and the subsequent treatment comprises bombarding the coating with particulate so as to embed the particulate in the polymeric coating.

12. The method of claim 1, wherein the coating forms a carrier matrix.

13. The method of claim 12, wherein the carrier matrix contains one or more of the following: calcium phosphate, silica, alumina, titania, calcium sulphate, bio-glass, zirconia, stabilised zirconia, the oxide of a lanthanide, sodium bicarbonate, and biocompatible polymer.

14. The method of claim 12, wherein the antecedent material comprises an active agent, and wherein an active agent is:

a. bonded to the carrier matrix,
b. adsorbed on the carrier matrix, or
c. entrained within the carrier matrix.

15. The method of claim 14, wherein the active agent is one or more of the following: anti-restenosis agents, immunosupressants, anti-inflammatory agents, anti-cancer agents, antibiotics, anti-thrombosis agents, proteins, bone morphogenic protein, enzyme, calcium phosphate, oligo-peptides, n-halamine moieties, amines, imides, amides, polymers containing nitrogen-hydrogen bonds, quaternary ammonium ions, quaternary sulphonium ions, quaternary phosphonium ions, organo-metallics, colloidal metal, and the surface is rendered biocidal by exposing the coating to a halogen containing solvent to generate nitrogen-halogen bonds in the coating.

16. The method of claim 15, wherein the halogen containing solution is one or more of the following: hypochlorous acid, hypobromous acid, bleach, hypochlorite, perchlorate, hypobromite, perbromate, halogenated aqueous solutions, methylene chloride, methylene bromide, and halo-alkane solutions.

17. The method of claim 1, wherein the antecedent materials of the coating contain one or more of the following:

a. ions or sols of calcium, phosphorous, sulphur, titanium, vanadium, nickel, aluminum, zirconium, yttrium, silicon, tantalum, erbium, lanthanum, platinum, gold or silver, b. organo-metallics, carboxylates, alkoxides and esters of calcium, phosphorous, phosphite, sulphur, titanium, vanadium, nickel, aluminum, zirconium, yttrium, silicon, tantalum, erbium, lanthanum, platinum, gold or silver, c. Calcium phosphate, calcium sulfate, silica, silica glass, calcium phosphate glass, alumina, titania, zirconia, stabilized zirconia, oxides of lanthanides and precious metals, colloidal metal or metal alloys, d. Anti-restenosis agent, immunosupressant, anti-inflammatory agent, anticancer agent, antibiotic, anti-thrombosis agent, protein, enzyme or oligopeptides, and e. biocompatible polymers or sols of biocompatible polymers.

18. A method of forming a coating on a surface, the method comprising delivering an aerosol to the surface concomitant with bombarding the surface with particles in one or more gas streams so that antecedent materials of the coating provided within the gas stream(s) are transformed into the coating by the cooperative action of the particles impinging on the surface and presence of the aerosol, wherein the aerosol comprises at least in part the antecedent materials of the coating, wherein the aerosol is generated by atomizing a material comprising a liquid wherein the method does not utilize a high temperature plasma spray or thermal sputtering process, wherein the particles comprise particles having attached an outer layer of material, and wherein said outer layer of material comprises in part the antecedent materials of the coating.

* * * * *